US012134446B2

(12) United States Patent
Boumans

(10) Patent No.: US 12,134,446 B2
(45) Date of Patent: Nov. 5, 2024

(54) ACTIVE ROLL STABILISATION SYSTEM FOR VESSELS

(71) Applicant: WETECH B.V., Nuth (NL)

(72) Inventor: Patrick Louis Hubert Gerard Boumans, Nuth (NL)

(73) Assignee: WETECH B.V., Nuth (NL)

( * ) Notice: Subject to any disclaimer, the term of this patent is extended or adjusted under 35 U.S.C. 154(b) by 498 days.

(21) Appl. No.: 17/602,122

(22) PCT Filed: Apr. 7, 2020

(86) PCT No.: PCT/EP2020/059916
§ 371 (c)(1),
(2) Date: Oct. 7, 2021

(87) PCT Pub. No.: WO2020/208030
PCT Pub. Date: Oct. 15, 2020

(65) Prior Publication Data

US 2022/0144391 A1 May 12, 2022

(30) Foreign Application Priority Data

Apr. 10, 2019 (NL) ..... 2022917

(51) Int. Cl.
*B63B 39/06* (2006.01)
*B63B 79/10* (2020.01)

(52) U.S. Cl.
CPC ..... *B63B 39/06* (2013.01); *B63B 79/10* (2020.01)

(58) Field of Classification Search
CPC ..... B63B 39/00; B63B 39/04; B63B 39/06; B63B 79/00; B63B 79/10; B63B 2039/066
(Continued)

(56) References Cited

U.S. PATENT DOCUMENTS 3,757,723 A * 9/1973 Pangalila ..... B63B 39/06 114/126
4,777,899 A 10/1988 Bettcher, Jr.
(Continued)

FOREIGN PATENT DOCUMENTS

JP 2013006578 A 1/2013
NL 1027525 C1 5/2006

OTHER PUBLICATIONS

International Search Report mailed May 14, 2020 for PCT/EP2020/059916.

*Primary Examiner* — Lars A Olson
(74) *Attorney, Agent, or Firm* — Suiter Swantz IP

(57) ABSTRACT

An active roll stabilisation system for vessels, the system comprising at least one stabilisation element that extends from the vessel's hull, below the water line, on a side of the vessel, sensor means for sensing the vessel's motion and delivering control signals on the basis thereof, as well as moving means for moving the at least one stabilisation element relative to the hull in dependence on at least the control signals delivered by the sensor means, wherein the moving means are arranged for imparting at least a pivoting movement in the direction of the stem or the stern of the vessel to the at least one stabilisation element and wherein the moving means comprise a first hydraulic drive assembly for moving one stabilisation element, said first hydraulic drive assembly being composed of at least one auxiliary hydraulic cylinder for moving the stabilisation element relative to the hull and a main hydraulic cylinder for driving the at least one auxiliary hydraulic cylinder.

19 Claims, 17 Drawing Sheets

(58) Field of Classification Search
USPC ..... 114/122, 126
See application file for complete search history.

(56) References Cited

U.S. PATENT DOCUMENTS 6,978,728 B2 * 12/2005 Koop ..... B63B 39/06
114/122
10,363,999 B2 * 7/2019 Koop ..... B63B 39/06

* cited by examiner

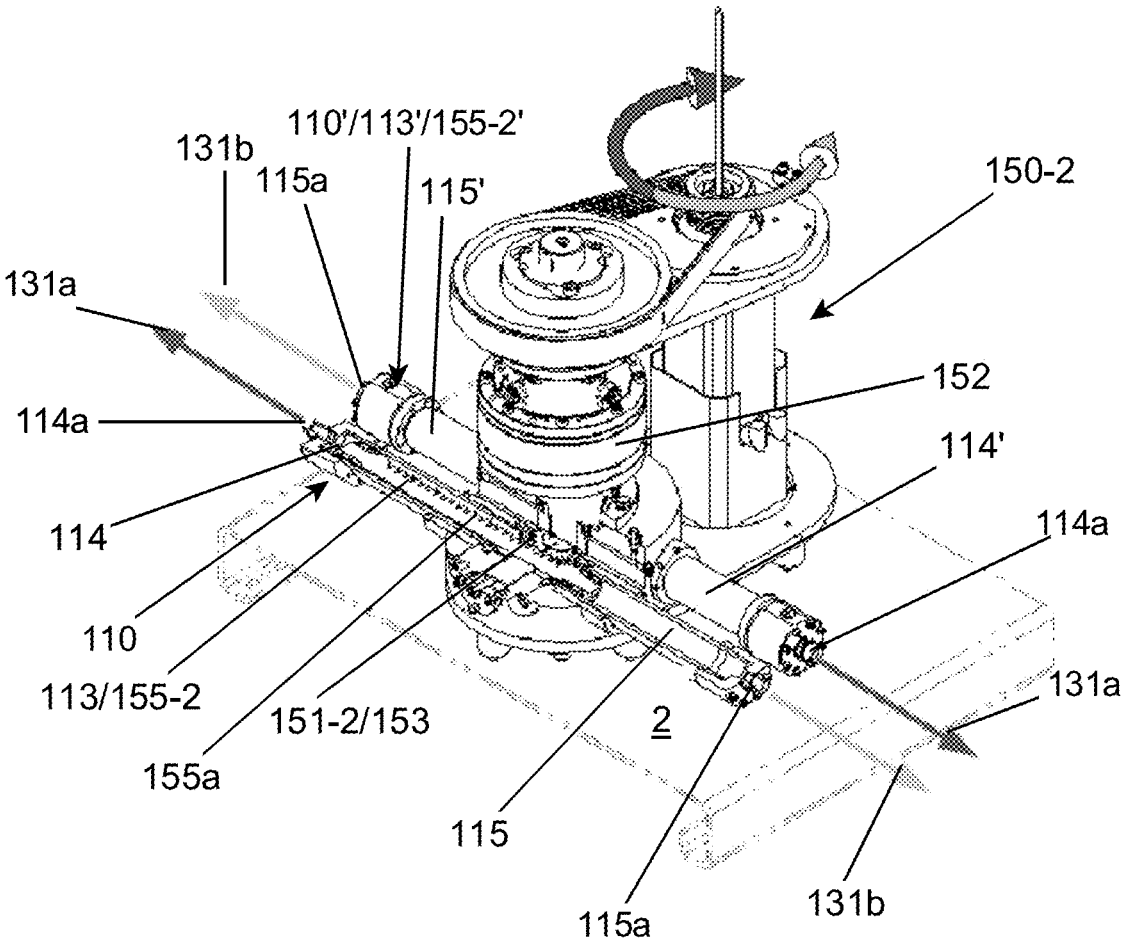
Fig. 6F-a

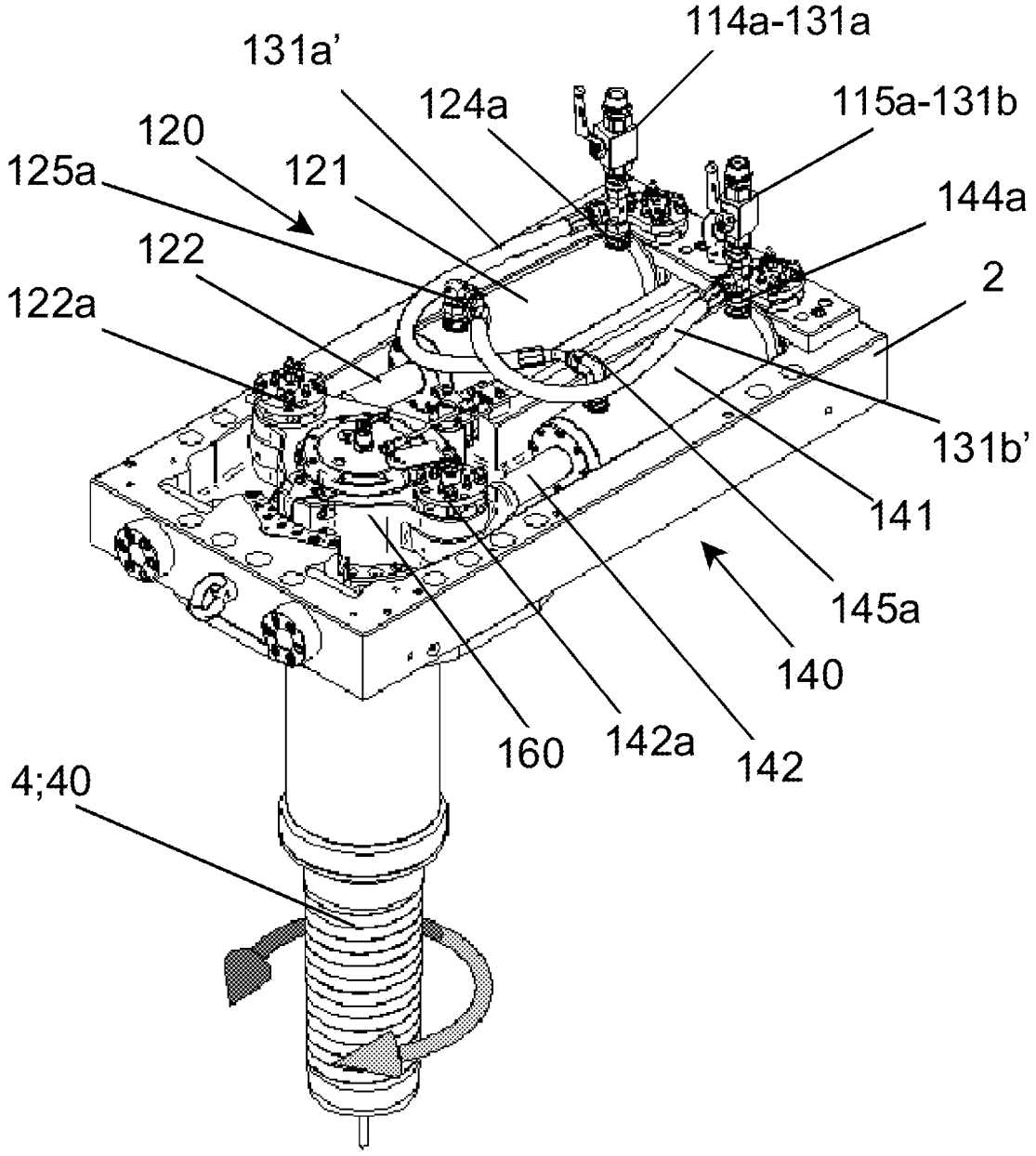
Fig. 6F-b

ACTIVE ROLL STABILISATION SYSTEM FOR VESSELS

TECHNICAL FIELD AND BACKGROUND

The invention relates to an active roll stabilisation system for vessels comprising at least one stabilisation element that extends from the vessel's hull, below the water line, on a side of the vessel, sensor means for sensing the vessel's motion and delivering control signals on the basis thereof, as well as moving means for moving the at least one stabilisation element relative to the hull.

Such an active system for damping a ship or vessel's motion is known, for example from NL U.S. Pat. No. 1,027,525. In said patent it is proposed to rotated a stabilisation element that extends from the vessel's hull below the waterline about its longitudinal axis so as to compensate for the vessel's roll. The vessel is for that purpose fitted with sensor means, for example angle sensors, speed sensors and acceleration sensors, by means of which the angle, the speed or the acceleration of the roll are sensed. Control signals are generated on the basis of the data being obtained, which signals control the rotation of the rotatable stabilisation element as regards the direction of rotation and the speed of rotation of the stabilisation element as well as the movement of the stabilisation element relative to the vessel;

Under the influence of the rotational movement of the stabilisation element and the water flowing past as a result of the stabilisation element moving relative to the stationary vessel, a correction force perpendicular to the direction of rotation and the direction of movement is generated. This physical phenomenon is also referred to as the Magnus effect, on the basis of which the correction force is used for opposing the vessel's roll. This stabilisation system based on the Magnus effect already provides a very large correction force at very slow sailing speeds through the water, which force is used as a lifting force for opposing the vessel's roll.

A drawback of the stabilisation systems described in NL 1027525 is that a reciprocating translational movement relative to the vessel's hull is imparted to the rotating stabilisation elements by the moving means. This means constant switching over of the moving means for accelerating and decelerating the mass of the rotating stabilisation element in one translation direction and accelerating and decelerating the mass of the rotating stabilisation element in the other, opposite translation direction. The mass inertia of the system further has an adverse effect on the smooth functioning of the system, because also the direction of rotation of the wing-shaped stabilisation elements must constantly be reversed by actuating the driving means.

This acceleration-deceleration and reacceleration of mass constitutes a severe demand on the energy supply on board the vessel in question. A heavy load is placed on the generators of the moving means or driving means, which load varies constantly on account of the switching over that is required. This variation is offset as much as possible by (in the case of hydraulic drive) the use of accumulators that level off the peak currents. In case of a hydraulic drive a hydraulic fluid is usually being supplied by means of a power pack, which includes a hydraulic pump controlled by an electric motor, a fluid tank, a lot of appendages like a manifold with various kind of valves and sensors, and a lot of piping and/or hoses.

The amount of hydraulic fluid is usually controlled by valves, which control the speed, the flow and the pressure of the hydraulic fluid used to activate the moving means or driving means. A lot of energy is being wasted or transformed into heat, as the power pack is usually running continuously or at variable speeds and needs to be over dimensioned to overcome the needed peak loads and flow.

In the case of direct electric drive this will be more difficult, and an even more complex and costly on-board installation will be required.

The mass forces that occur therewith have an adverse effect on the functionality of this stabilisation system. They do not contribute to the stabilisation and consequently increase the force requirement and thus the power requirement. The resistance forces generated in this way place a heavy load on the generators of the moving means or the driving means in this case as well. As a consequence, an overdimensioned power train of the stabilisation element is required, and the known power trains also create significant noise and vibrations caused by pump and fluid activity, which is undesirable in the event of leisure yachts, which are predominantly at anchor in harbours.

BRIEF SUMMARY

Accordingly it is an object of the invention to provide an active system for damping a vessel's motion as described in the introduction, which system does not suffer from the aforementioned drawbacks. According to the invention, an active roll stabilisation system for vessels is proposed, the system comprising at least one stabilisation element that extends from the vessel's hull, below the water line, on a side of the vessel, sensor means for sensing the vessel's motion and delivering control signals on the basis thereof, as well as moving means for moving the at least one stabilisation element relative to the hull in dependence on at least the control signals delivered by the sensor means, wherein the moving means are arranged for imparting at least a pivoting movement in the direction of the stem or the stern of the vessel to the at least one stabilisation element and wherein the moving means comprise a first hydraulic drive assembly for moving one stabilisation element, said first hydraulic drive assembly being composed of at least one auxiliary hydraulic cylinder for moving the stabilisation element relative to the hull and a main hydraulic cylinder for driving the at least one auxiliary hydraulic cylinder.

Herewith the continuous waste of electrical power is avoided, as the active stabilisation system, in fact the moving means, only supplies hydraulic fluid upon demand. Herewith the implementation of a continuously operating hydraulic pump is not needed, as well as no energy wasting valves, which parts are implemented in the known stabilisation configuration to control the needed flow or pressure.

With the invention the at least one auxiliary hydraulic cylinder for moving the stabilisation element relative to the hull and the main hydraulic cylinder for driving the at least one auxiliary hydraulic cylinder are in direct fluid connection with each other. This construction allows in an effective manner, that only an amount of fluid is delivered when it is mechanically activated, up to the maximum available fluid at the applicable side of the hydraulic cylinder. As a further advantage of this configuration of the moving means the amount of fluid in the hydraulic system is limited by the size (diameters and stroke) of the hydraulic cylinders used, which can be designed according to the requested volume and needed pressure.

In particular the main hydraulic cylinder comprises at least one main piston/cylinder combination composed of a main cylinder body and a main piston accommodated in the main cylinder body and provided with a main piston rod that projects from the main cylinder body, the main cylinder body and the main piston defining a first main cylinder chamber at one side of the main piston and a second main cylinder chamber at the other side of the main piston, and wherein the first hydraulic drive assembly further comprise a main drive means arranged for driving the main piston rod and the main cylinder body relative to each other in alternating forward and return operational cycles.

In two alternative embodiments the main drive means drive the main cylinder body/main piston rod. In particular the main piston rod/main cylinder body is fixed to the vessel's hull or the main piston rod/main cylinder body are fixed to the vessel's hull by means of a vibration free suspension. Herewith a further reduction in the generated noise during operation is achieved, which is desirable as many of such active stabilisation systems are used in leisure yachts, which are predominantly at anchor in harbours.

In a further example the auxiliary hydraulic cylinder comprises at least one auxiliary piston/cylinder combination composed of an auxiliary cylinder body and an auxiliary piston accommodated in the auxiliary cylinder body and provided with an auxiliary piston rod that projects from the auxiliary cylinder body, the auxiliary cylinder body and the auxiliary piston defining a first auxiliary cylinder chamber at one side of the auxiliary piston and a second auxiliary cylinder chamber at the other side of the auxiliary piston, and wherein the main cylinder is arranged for driving the auxiliary piston and the auxiliary cylinder body relative to each other in alternating forward and return operational cycles.

In particular the main cylinder drives the auxiliary cylinder body/auxiliary piston rod and wherein the auxiliary piston rod/auxiliary cylinder body is fixed to the vessel's hull.

In an efficient example of hydraulics the first main cylinder chamber is interconnected with the first auxiliary cylinder chamber and the second main cylinder chamber is interconnected with the second auxiliary cylinder chamber by means of fluid lines.

In a further example of hydraulics the auxiliary hydraulic cylinder comprises a second corresponding auxiliary hydraulic cylinder for moving the stabilisation element, wherein the auxiliary piston rods of both the first and second auxiliary cylinder are being coupled to a pivoting yoke for pivoting the stabilisation element. Herewith an efficient driving mechanism for driving the stabilisation element back and forth relative to the vessel's hull is obtained with a minimum amount of fluid to be pressurized and delivered through the hydraulics.

By interconnecting the first auxiliary cylinder chamber of the first auxiliary cylinder with the second auxiliary cylinder chamber of the second auxiliary cylinder and interconnecting the first auxiliary cylinder chamber of the second auxiliary cylinder with the second auxiliary cylinder chamber of the first auxiliary cylinder by means of fluid lines a further efficient hydraulics is created, an efficient displacement or moving of the stabilisation element relative to the vessel's hull is obtained with a minimum amount of fluid to be pressurized and delivered through the hydraulics.

As in these examples above the at least one (e.g. the first and second) auxiliary hydraulic cylinder for moving the stabilisation element relative to the hull and the main hydraulic cylinder for driving the at least one (first and second) auxiliary hydraulic cylinder are in direct fluid connection with each other by means of interconnecting fluid lines. Herewith an effectively operating construction is obtained, with only a limited amount of fluid to be displaced through the hydraulic system when the construction is activated, up to the maximum available fluid at the applicable side of the hydraulic auxiliary (first and second) and main cylinders. As a further advantage of this configuration of the moving means the amount of fluid in the hydraulic system is limited by the size (diameters and stroke) of the hydraulic cylinders used, which can be designed according to the requested volume and needed pressure.

In a further example the main drive means comprise a spindle drive or a belt drive or a rack and pinion drive, which can be operated in an efficient on/off fashion for driving the main cylinder in alternating forward and return operational cycles, without creating a too high demand on the energy supply on board the vessel.

In a further embodiment the one stabilisation element is provided with a sub-element that is movable with respect to the stabilisation element and the moving means comprise a second hydraulic drive assembly according to the invention, with the first hydraulic drive assembly being arranged for imparting a pivoting movement in the direction of the stem or the stern of the vessel to the one stabilisation element relative to the hull and the second hydraulic drive assembly being arranged for moving the sub-element with respect to the stabilisation element.

In particular the sub-element can be moved in and out of the main body of the stabilisation element, and herewith an additional stabilisation of the vessel can be achieved.

In a specific embodiment of this aspect of the invention, the stabilisation element can be accommodated in a recess formed in the vessel's hull, so that the stabilisation element can be returned to its position in the vessel's hull, if desired, while the vessel is sailing, so that the friction between the vessel and the water will decrease considerably while sailing.

In a specific embodiment of the active roll stabilisation system according to the invention, the stabilisation element is shaped as a wing, wherein the wing-shaped stabilisation element is provided with a winglet at its free end. This reduces any swirling in the water flowing past the wing-shaped stabilisation element (with stationary vessels as well as with moving vessels), as a result of which the wing-shaped stabilisation element can on the one hand be moved through the water in a simpler and more efficient manner, so that the drive system can be of less sturdy construction and consumes less energy and power. The induced resistance experienced by the stabilisation element in the water will furthermore decrease.

In a preferred embodiment, the winglet is directed toward the water surface or away from the water surface.

In another functional embodiment according to the invention, the wing-shaped stabilisation element has an Aspect-Ratio ranging between 1 and 10. By using a wing-shaped stabilisation element having such a large Aspect-Ratio, an enhanced lifting effect for damping the vessel's roll is realised, so that the active roll stabilisation system provided with such a wing-shaped stabilisation element (having a high AR) can also be used for applications other than roll stabilisation, for example for trimming the vessel, or for compensating for the vessel's pitch or even for repositioning or manoeuvring the vessel without making use of the usual main propulsion system of the vessel or of bow and stern thrusters.

In this latter embodiment, the active roll stabilisation system according to the invention further comprises location determination means, and the moving means impart the angular displacement to the at least one wing-shaped stabilisation element and set the tilt angle of the at least one wing-shaped stabilisation element in part on the basis of the determined position of the vessel.

This makes it possible, by imparting a "wagging" motion to the wing-shaped stabilisation element, to keep the vessel in its position in the harbour, or even move it over small distances, without making use of the vessel's main propulsion system, so that manoeuvres can be carried out in a controlled manner.

Optionally, the stabilisation element can be accommodated in a guide formed in or on the vessel's hull, which guide preferably extends at least partially in the longitudinal direction of the vessel.

According to another functional embodiment, stabilisation elements may be provided on each longitudinal side of the vessel or only on one side, whilst in another embodiment two or more stabilisation elements are provided at the front side of the vessel, and wherein in another example the set of stabilisation elements is provided near the rear of the vessel.

The invention also relates to a hydraulic motor means comprising at least one auxiliary hydraulic cylinder for moving a load in alternating forward and return operational cycles and a main hydraulic cylinder for driving the at least one auxiliary hydraulic cylinder as defined here in this patent application and its claims.

BRIEF DESCRIPTION OF THE DRAWINGS

The invention will now be explained in more detail with reference to a drawing, in which:

FIGS. 6A-6G embodiments of examples of main drive means for use in the moving means according to the invention;

DETAILED DESCRIPTION

Figure 1:
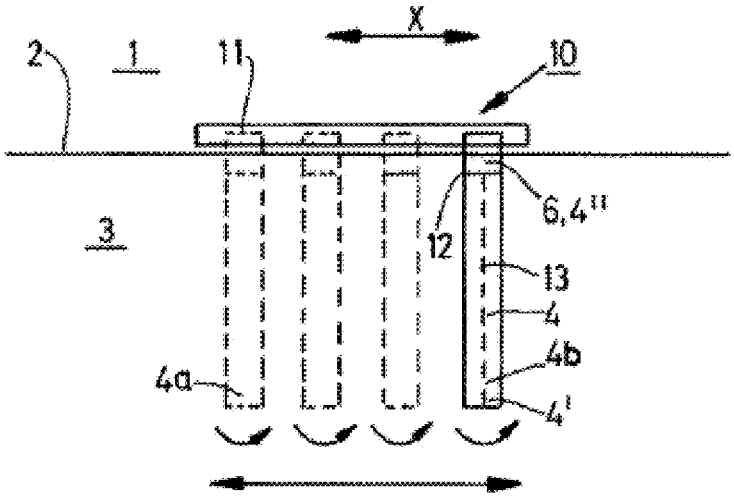
FIGS. 1-4 are views of active stabilisation systems according to the prior art.

In FIGS. 1-4 embodiments of active stabilisation systems according to the prior art are shown. The stationary ship or vessel 1 floating on a water surface 3 is provided with an active stabilisation system indicated by reference numerals Oct. 11, 2020-10'-20'. This known active system for damping a vessel's motion as described in Dutch patent NL 1027525 is made up of rotatable stabilisation elements 4*a* and 4*b*, which each project from a respective longitudinal side of the hull 2 of the vessel below the waterline.

The active stabilisation system according to the prior art is also provided with sensor means (not shown, however) which sense the vessel's motion and more in particular the vessel's roll. On the basis of this, control signals are delivered to driving means (likewise not shown), which rotatably drive either one of the stabilisation elements 4*a* or 4*b* (depending on the correction to be carried out). Said sensor means may consist of angle sensors, speed sensors or acceleration sensors, which continuously sense the angle of the vessel relative to the horizontal water surface 3 and the speed or the acceleration caused by the vessel's roll.

FIG. 1 shows an embodiment of a known active stabilisation system provided with a set of rotatable stabilisation elements. The stabilisation elements may be configured as a cylinder or as a wing. The active stabilisation system comprises moving means which move the rotatable stabilisation element 4 with respect to the stationary vessel. More in particular, FIG. 1 shows an embodiment in which the moving means 10 impart a reciprocating translational movement between two extreme positions 4*a* and 4*b* to the rotatable stabilisation element, such that said movement comprises at least a component in the longitudinal direction of the vessel. The longitudinal direction of the vessel is indicated by the wide arrow X in FIG. 1. In the case of the translating embodiment of the active stabilisation system shown in FIG. 1 (see also FIG. 2), the translational movement of the rotatable stabilisation element 4 is made possible in that a guide 11 is mounted in the hull 2 of the vessel 1, along which guide the stabilisation element 4 can be moved. The rotatable stabilisation element 4 is to that end accommodated in the guide 11 with one end 4' via a universal joint 12, so that translational movement in the guide 11 on the one hand and a rotational movement about the longitudinal axis 13 on the other hand are possible.

Although this is schematically shown, the rotatable stabilisation element 4 is connected to the driving means 6 by means of a universal joint 12, which driving means rotatably drive the stabilisation element 4 for the purpose of damping the vessel's motion being sensed. In this embodiment, the assembly of the driving means 6 and the universal joint 12 (which enables the stabilisation element 4 to rotate with respect to the driving means 6 and the vessel 1) can translate along the guide 11, for example via a rack-and-pinion transmission mechanism (not shown).

Also other translational transmission mechanisms can be used for this purpose, however.

The reciprocating translational movement of the rotatable stabilisation element 4 in the guide 11, between the extreme positions 4*a* and 4*b*, in the longitudinal direction X of the stationary vessel 1 combined with the rotational movement of the stabilisation element 4 results in a reactive force, also referred to as the Magnus force. This force is perpendicular both to the direction of movement of the stabilisation element 4 in the X-direction and to the direction of rotation thereof. Depending on the direction of the vessel's motion (the vessel's roll) to be damped, the direction of rotation of the stabilisation element 4 must be selected so that the resulting Magnus force FM will oppose the rolling force FR being exerted on the vessel as a result of the vessel's roll.

Figure 2:
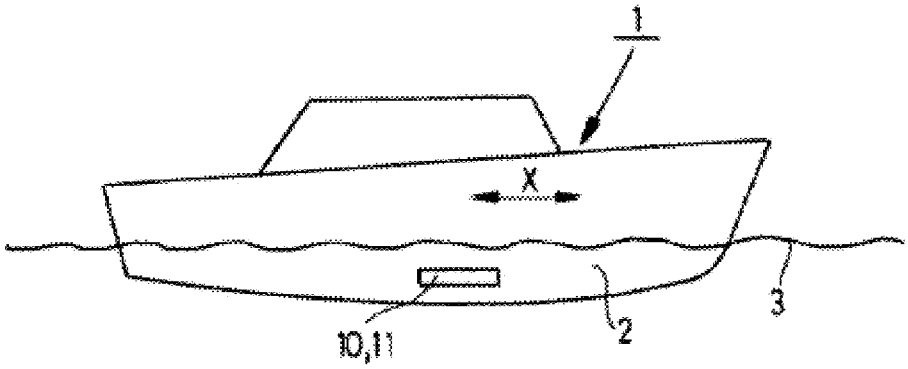
Figure 3:
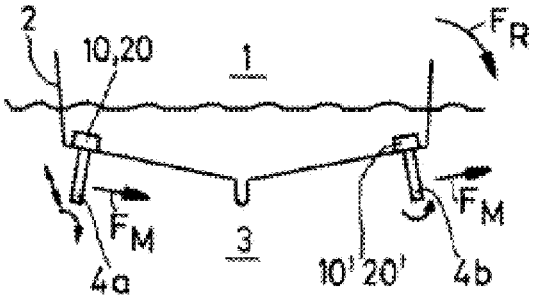

This is shown in FIG. 3, in which the translating rotatable stabilisation elements 4*a*-4*b* are disposed below the water line 3, near the centre of the vessel (see FIG. 2). The direction, the speed as well as the acceleration of the roll can be sensed in a manner which is known per se, using suitable sensor means (angle sensor, speed sensor and acceleration sensor). Control signals are delivered on the basis thereof to the respective driving means 6 and 10. On the basis of said signals, the driving means 6 will drive the stabilisation element 4 at a speed and in a direction which may or may not be varied, whilst the moving means 10 will also move the rotating stabilisation element 4 in the longitudinal direction X in the guide 10 at a certain speed.

Figure 4:
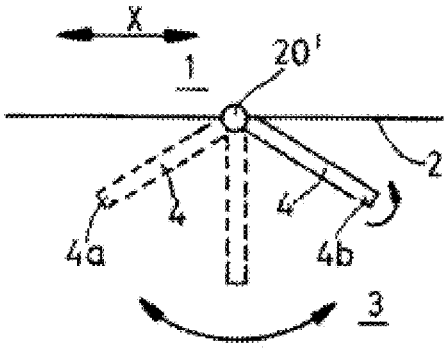

In FIG. 4 another embodiment of a known active stabilisation system is shown, in which the moving means (indicated at 20 here) impart a reciprocating pivoting movement between two extreme positions 4*a* and 4*b* with respect to the stationary vessel 1 to the stabilisation element 4. In order to ensure that the active stabilisation system will function adequately with stationary vessels, it is desirable, also in the embodiment shown in FIG. 4, that the pivoting movement imparted to the rotatable stabilisation element 4 by the moving means 20 should comprise at least a motion component in the longitudinal direction X of the vessel 1.

In the above setup, using a suitable control and drive of the stabilisation element 4 in terms of rotational speed, direction and pivoting speed and direction, the Magnus effect in the case of a stationary vessel being at anchor will for example result in a Magnus force FM comprising at least a force component in the direction of or away from the water surface 3. Said upward or downward, as the case may be, force component of the Magnus force FM can be utilised very effectively for compensating the roll of the stationary vessel about its longitudinal axis X.

The acceleration-deceleration and reacceleration of the mass of the stabilisation elements 4 in a reciprocating pivoting manner between the two extreme positions 4*a* and 4*b* constitutes a severe demand on the energy supply on board the vessel 1 in question. A heavy load is placed on the generators of the moving means or driving means, which load varies constantly on account of the switching over that is required. This variation is offset as much as possible by (in the case of hydraulic drive) the use of accumulators that level off the peak currents. In case of a hydraulic drive a hydraulic fluid is usually being supplied by means of a power pack, which includes a hydraulic pump controlled by an electric motor, a fluid tank, a lot of appendages like a manifold with various kind of valves and sensors, and a lot of piping and/or hoses.

The amount of hydraulic fluid is usually controlled by valves, which control the speed, the flow and the pressure of the hydraulic fluid used to activate the moving means or driving means. A lot of energy is being wasted or transformed into heat, as the power pack is usually running continuously or at variable speeds and needs to be over dimensioned to overcome the needed peak loads and flow.

In the case of direct electric drive this will be more difficult, and an even more complex and costly on-board installation will be required.

The mass forces that occur therewith have an adverse effect on the functionality of this stabilisation system. They do not contribute to the stabilisation and consequently increase the force requirement and thus the power requirement. The resistance forces generated in this way place a heavy load on the generators of the moving means or the driving means in this case as well. As a consequence, an over dimensioned power train of the stabilisation element is required, and the known power trains also create significant noise and vibrations caused by pump and fluid activity, which is undesirable in the event of leisure yachts, which are predominantly at anchor in harbours.

Figure 5A:
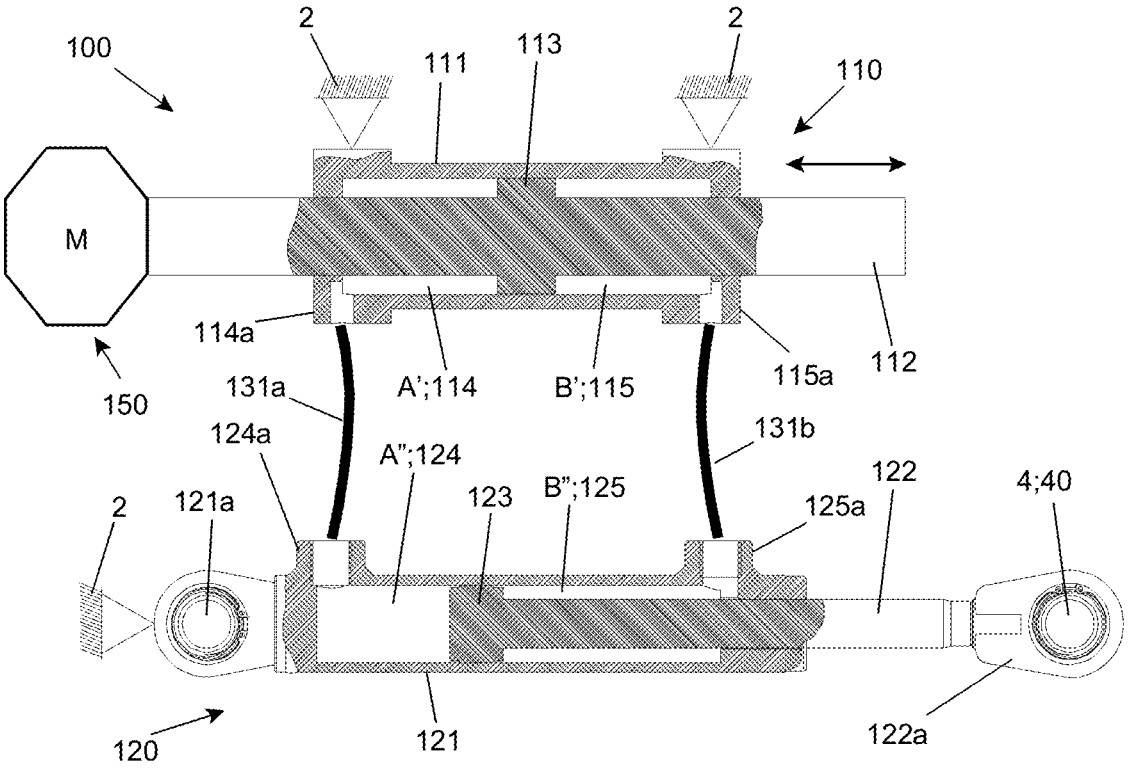
FIGS. 5A-5C embodiments of examples of moving means according to the invention.
Figure 5B:
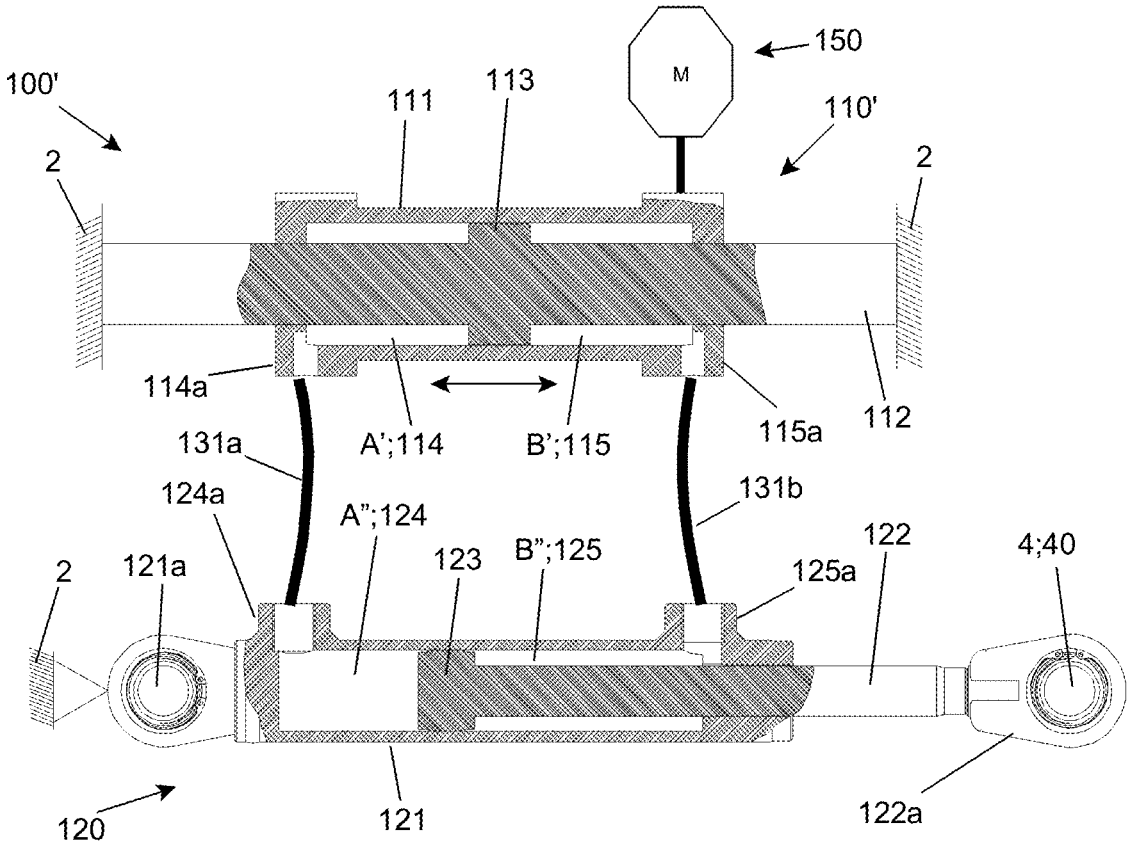
Figure 5C:
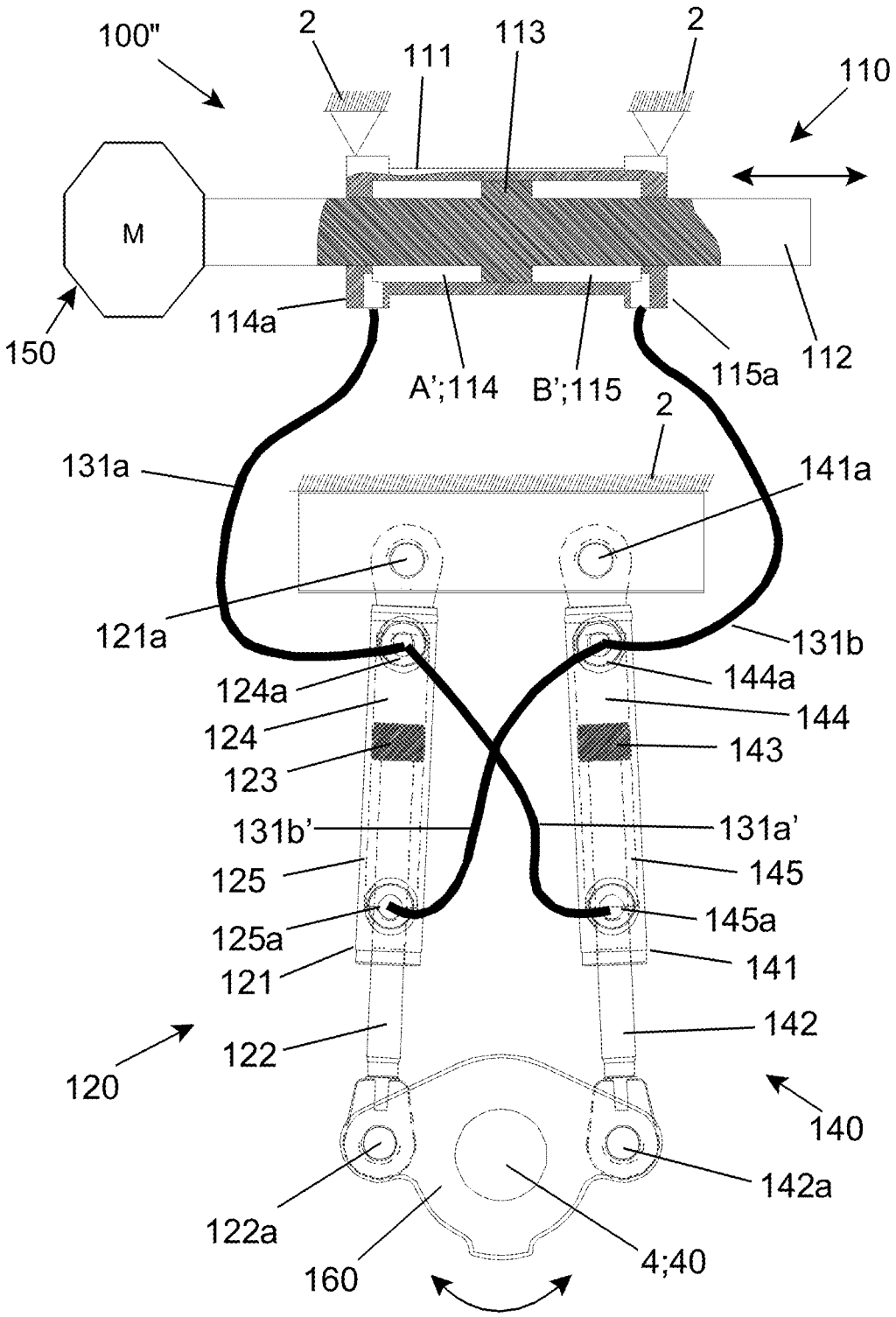

In FIGS. 5A-5C several different embodiments are shown of moving means, which can be implemented in active stabilisation systems having at least one stabilisation element to compensate for the vessel's roll movements.

A first embodiment is shown in FIG. 5A where a first example of the moving means according to the invention is shown are denoted with reference numeral 100. In this example the moving means for driving the at least one stabilisation element 4 in an active stabilisation system comprise a first hydraulic drive assembly 100. The first hydraulic drive assembly 100 is solely used for moving one single stabilisation element 4 relative to the hull 2 of a vessel 1 in dependence on at least the control signals delivered by the sensor means as outlined above.

In particular the examples of the hydraulic moving means depicted in FIGS. 5A-5C are intended for imparting at least a pivoting or translational movement to the one single stabilisation element 4 in the direction of the stem or the stern of the vessel 1.

The first hydraulic drive assembly 100 (of FIG. 5A), 100' (of FIG. 5B) are composed of at least one auxiliary hydraulic cylinder 120 for moving the stabilisation element 4 relative to the hull 2. Each hydraulic drive assembly 100-100' also comprises a main hydraulic cylinder 110 (FIG. 5A) and 110' (FIG. 5B) for driving the at least one auxiliary hydraulic cylinder 120. In general it is noted that first hydraulic drive assembly 100-100'-100" (example of FIG. 5C) comprises one main hydraulic cylinder 110-110' and one or more auxiliary hydraulic cylinders.

In all examples of FIGS. 5A-5C the main hydraulic cylinder 110-110' comprises at least one main piston/cylinder combination 111-112-113, composed of a main cylinder body 111 and a main piston 113 accommodated in the main cylinder body 111. The main piston 113 is mounted to a main piston rod 112 that projects from both sides from the main cylinder body 111. The main cylinder body 111 and the main piston 113 define a first main cylinder chamber 114 at one side of the main piston 113 and a second main cylinder chamber 115 at the other side of the main piston 113. It is noted that in all embodiments described hereafter in the detailed description, each piston 113 is provided with a sealing (not shown) thus preventing any leakage between both first and second main cylinder chamber 114-115 across the piston 113.

Additionally each first hydraulic drive assembly 100-100'-100" comprises main drive means 150 schematically depicted with M in FIGS. 5A-5C. The main drive means 150 are arranged for driving the main piston rod 112 and the main cylinder body 111 relative to each other in alternating forward and return operational cycles, depicted in FIGS. 5A-5C by means of the double arrow placed alongside the main piston rod 112.

The two mechanically equivalent examples of the main drive means 150 driving the main cylinder body 111 and the main piston rod 112 relative to each other are shown in FIGS. 5A and 5B, respectively.

In FIG. 5A the main drive means 150 is mounted to and drives the main piston rod 112 in alternating forward and return operational cycles in (and relative to) the main cylinder body 111, the latter component being fixed to the vessel's hull 2 (permanent world). In the other example of FIG. 5B the main piston rod 112 is fixed with each both ends to the vessel's hull 2 (permanent world) whereas the main drive means 150 is mounted to and drives the main cylinder body 111 in alternating forward and return operational cycles relative to the main piston rod 112.

Alternatively the main piston rod 112 (FIG. 5B) or the main cylinder body 111 (FIG. 5A) are fixed to the vessel's hull 2 by means of a vibration free suspension (not shown). Herewith a significant reduction in the generated noise during operation of the active roll stabilisation system is achieved, which is desirable as many of such active roll stabilisation systems are used in leisure yachts, which are predominantly at anchor in harbours.

The displacement of the main cylinder body 111 and the main piston rod 112 in alternating forward and return operational cycles relative to each other by the main drive means 150 causes a similar alternating displacement of the main piston 113 in the main cylinder body 111. This results in an alternating decrease and increase of the volume of the first and the second main cylinder chamber 114 and 115, respectively.

Both first and second main cylinder chamber 114-115 are filled with a fluid, in particular a non-compressible fluid, such as oil.

The auxiliary hydraulic cylinder 120 of the first hydraulic drive assembly 100-100' comprises at least one auxiliary piston/cylinder combination 120, in FIGS. 5A-5B the number of auxiliary piston/cylinder combinations is one (1). The single auxiliary piston/cylinder combination 120 of the examples shown in FIGS. 5A-5B is composed of an auxiliary cylinder body 121 and an auxiliary piston 123 accommodated in the auxiliary cylinder body 121. The auxiliary piston 123 is mounted to an auxiliary piston rod 122 that projects at one side from the auxiliary cylinder body 121.

Similar to the main hydraulic cylinder 110-110', also the auxiliary cylinder body 121 and the auxiliary piston 123 define a first auxiliary cylinder chamber 124 at one side 121*a* of the auxiliary piston 123 (and the auxiliary hydraulic cylinder 120) and a second auxiliary cylinder chamber 125 at the other side 122*a* of the auxiliary piston 123 (and the auxiliary hydraulic cylinder 120).

As depicted in the two examples of FIGS. 5A-5B, the first main cylinder chamber 114 is interconnected with the first auxiliary cylinder chamber 124 and the second main cylinder chamber 115 is interconnected with the second auxiliary cylinder chamber 125 by means of first and second fluid lines 131*a* and 131*b*, respectively. Hereto each cylinder chamber 114-115-124-125 is provided with suitable fluid connections or couplings 114*a*-115*a*-124*a*-125*a*, respectively, which connections or couplings are known in the art and capable of withstanding the high fluid pressures and fluid velocities, which might occur during the alternating cycles of the hydraulic moving means 100-100'-110" (FIG. 5C).

As such, in the examples of FIGS. 5A and 5B both the (volume of the) first main cylinder chamber 114 and the (volume of the) first auxiliary cylinder chamber 124 form a combined fluid volume (together with the volume of the first fluid line 131*a*) and the (volume of the) second main cylinder chamber 115 and the (volume of the) second auxiliary cylinder chamber 125 form a combined fluid volume (together with the volume of the second fluid line 131*b*). As shown the several interconnected cylinder chambers 114-124 (and 115-125) form a system of communicating vessels.

Operating the main drive means 150 causes the main cylinder body 111 and the main piston rod 112 to move in alternating forward and return operational cycles relative to each other, resulting in a volume decrease and a simultaneous volume increase of either first/second main cylinder chamber 114-115. And due to the fluid communication between the first cylinder chambers 114-124 and second cylinder chambers 115-125 the volume decrease/increase in the main cylinder chambers 114-115 causes a simultaneous volume increase/decrease in the auxiliary cylinder chambers 124-125.

Herewith as shown in FIGS. 5A-5B, the main cylinder 110-110' drives the auxiliary piston rod 122 in alternating forward and return operational cycles (out and in cycles) due to the subsequent volume decrease/increase in the several cylinder chambers, wherein the auxiliary cylinder body 121 is fixed with its end 121*a* to the vessel's hull 2. In a mechanically equivalent example the auxiliary cylinder body 121 is displaced in a similar fashion by the main cylinder 110-110' wherein the auxiliary piston rod is fixed with its free end 122*a* to the vessel's hull 2.

As the at least one auxiliary hydraulic cylinder 120 for moving the stabilisation element 4-40 relative to the hull 2 and the main hydraulic cylinder 110 for driving the at least one auxiliary hydraulic cylinder 120 are in direct fluid connection with each other by means of interconnecting fluid lines 131*a*-131*b* an effectively operating construction 100 is obtained, with only a limited amount of fluid to be displaced through the hydraulic system when the construction is activated, up to the maximum available fluid at the applicable side of the hydraulic auxiliary 120 and main 110 cylinders.

As a further advantage of this configuration of the moving means the amount of fluid in the hydraulic system is limited by the size (diameters and stroke) of the hydraulic cylinders used, which can be designed according to the requested volume and needed pressure.

In the example as shown in FIG. 5C, the first hydraulic drive assembly 100" comprises next to the first auxiliary hydraulic cylinder 120 a second corresponding auxiliary hydraulic cylinder 140, both auxiliary hydraulic cylinders 120-140 intended for moving one, single stabilisation element 4. In this example of FIG. 5C, the second auxiliary hydraulic cylinder 140 has an identical configuration and dimensions as that of the first auxiliary hydraulic cylinder 120. Also the second auxiliary hydraulic cylinder 140 is composed of an auxiliary cylinder body 141 and an auxiliary piston 143 accommodated in the auxiliary cylinder body 141. The auxiliary piston 143 is mounted to an auxiliary piston rod 142 that projects at one side from the auxiliary cylinder body 141.

Similarly, the auxiliary cylinder body 141 and the auxiliary piston 143 define a first auxiliary cylinder chamber 144 at one side 141*a* of the auxiliary piston 143 (and the auxiliary hydraulic cylinder 140) and a second auxiliary cylinder chamber 145 at the other side 142*a* of the auxiliary piston 143 (and the auxiliary hydraulic cylinder 140). Also here it is noted that in all embodiments described hereafter in the detailed description, each auxiliary piston 123 and 143 is provided with a sealing (not shown) thus preventing any leakage between their respective first and second auxiliary cylinder chambers across the auxiliary piston. Both auxiliary cylinder bodies 121-141 are fixed with their ends 121*a*-141*a* to the vessel's hull 2 (permanent world). The auxiliary piston rods 122-142 of both the first and second auxiliary cylinder 120-140 are coupled with their free ends 122*a*-142*a* to a pivoting yoke 160 for pivoting the stabilisation element 4 around its stabilisation axis 40, as will be explained further in the description.

As to the direct fluid interconnection of the several cylinder chambers 114-115; 124-125 and 144-145 the first auxiliary cylinder chamber 124 of the first auxiliary cylinder 120 is interconnected with the second auxiliary cylinder chamber 145 of the second auxiliary cylinder 140 and the first auxiliary cylinder chamber 144 of the second auxiliary cylinder 140 is interconnected with the second auxiliary cylinder chamber 125 of the first auxiliary cylinder 120 by means of intermediate first and second fluid lines 131*a*' and 131*b*', respectively via suitable fluid connections or couplings 124*a*-125*a*-144*a*-145*a* of a similar build and configuration as described with reference to the examples of FIGS. 5A and 5B.

In other words, in the example of FIG. 5C the (volume of the) first main cylinder chamber 114, the (volume of the) first auxiliary cylinder chamber 124 of the first auxiliary cylinder 120 and the (volume of the) second auxiliary cylinder chamber 145 of the second auxiliary cylinder 140 form a combined fluid volume (together with the volumes of the first fluid line 131*a* and the first intermediate fluid line 131*a*'). Likewise the (volume of the) second main cylinder chamber 115, the (volume of the) second auxiliary cylinder chamber 125 of the first auxiliary cylinder 120 and the (volume of the) first auxiliary cylinder chamber 144 of the second auxiliary cylinder 140 form a combined fluid volume (together with the volumes of the second fluid line 131*b* and the second intermediate fluid line 131*b*'). As shown, the several interconnected cylinder chambers 114-124-145 (and 115-125-144) form a system of communicating vessels.

Also in this example the first and second auxiliary hydraulic cylinders 120-140 for moving the stabilisation element 4-40 relative to the hull 2 and the main hydraulic cylinder 110 for driving both auxiliary hydraulic cylinder 120-140 are in direct fluid connection with each other by means of interconnecting fluid lines 131*a*-131*b*-131*a*'-131*b*'. In a similar fashion herewith an effectively operating construction 100' is obtained without the implementation of a complex hydraulic valve system, as only a limited amount of fluid is to be displaced through the hydraulic system when the construction is activated, up to the maximum available fluid at the applicable side of the hydraulic auxiliary 120-140 and main 110 cylinders.

As a further advantage of this configuration of the moving means the amount of fluid in the hydraulic system is limited by the size (diameters and stroke) of the hydraulic cylinders used, which can be designed according to the requested volume and needed pressure.

In the example of FIG. 5C the main cylinder 110 corresponds to the example of the main cylinder as depicted in FIG. 5A, however also the mechanical equivalent of the main cylinder 110' as shown in the example of FIG. 5B can be likewise implemented in the example of the FIG. 5C.

Operating the main drive means 150 causes the main piston rod 112 to move in alternating forward and return operational cycles relative to the main cylinder body 111, resulting in a volume decrease and a simultaneous volume increase of either first/second main cylinder chamber 114-115. And due to the direct interconnected fluid communication between the combined cylinder chambers 114-124-145 and the combined cylinder chambers 115-125-144 the volume decrease/increase in the main cylinder chambers 114-115 causes a simultaneous volume increase/decrease in said interconnected auxiliary cylinder chambers 124-145 and 125-144, respectively.

Herewith as shown in FIG. 5C, the main cylinder 110 drives the auxiliary piston rods 122 and 142 in an alternating forward and return, yet opposite operational cycles (opposite out and in cycles) due to the subsequent volume decrease/increase in the several interconnected cylinder chambers 124-145 and 125-144 with the main cylinder chambers 114-115. Due to the mounting of the free ends 122*a*-142*a* of the auxiliary piston rods 122-142 to the pivoting yoke 160 a large pivoting momentum can be transferred to the rotating axis 40 of the stabilisation element 4 for compensating or counteracting the vessel's roll movements.

In a mechanically equivalent example the auxiliary cylinder bodies 121-141 are interconnected with the pivoting yoke 160 and can be displaced in a similar, yet opposite fashion by the main cylinder 110-110' wherein the auxiliary piston rods 122-142 are fixed with their free ends 122*a*-142*a* to the vessel's hull 2 (permanent world).

By configuring the moving means in an active roll stabilisation system as hydraulic drive assemblies 100-100'-100" as depicted in the first, second and third examples of the FIGS. 5A-5B-5C the continuous waste of electrical power is prevented, as in the active stabilisation system, the hydraulic drive assemblies 100-100'-100" in fact the main hydraulic cylinder 110-110' with the main drive means 150, only supplies hydraulic fluid upon demand. Herewith the implementation of a continuously operating hydraulic pump is not needed, as well as no energy wasting valves, which parts are implemented in the known stabilisation configuration to control the needed flow or pressure.

With shown examples of the hydraulic drive assemblies 100-100'-100" depicting a direct fluid connection between the at least one auxiliary hydraulic cylinder for moving the stabilisation element relative to the hull and the main hydraulic cylinder for driving the at least one auxiliary hydraulic cylinder by means of interconnecting fluid lines, an effectively operating active roll stabilisation system is obtained, wherein only a limited amount of fluid is to be displaced through the hydraulic system when the construction is activated, up to the maximum available fluid at the applicable side of the hydraulic auxiliary and main cylinders.

In particular, only an amount of hydraulic fluid is delivered when the main hydraulic cylinder 110-110' is mechanically activated by the main drive means 150, up to the maximum available fluid at the applicable side of the main hydraulic cylinder 110-110', in dependence on the dimensions of (the piston and the cylinder chambers of) the main hydraulic cylinder 110-110'. As a further advantage of this configuration of the hydraulic drive assemblies 100-100'-100" the amount of hydraulic fluid in the hydraulic system is limited by the diameters and stroke length of the pistons 113-123-143 and piston rods 112-122-142 and the size/dimensions of the (combined) hydraulic cylinders 114+124/115+124, 114+124+145/115+125+144 respectively, as used, which dimensions can be designed according to the requested volume and needed pressure.

Due to this free design any (pivoting) momentum can be generated by the hydraulic drive assemblies 100-100'-100" and transferred to the rotating axis 40 of the stabilisation element 4 for compensating or counteracting the vessel's roll movements.

In FIGS. 6A-6G several examples of main drive means 150 for use in any of the examples of the hydraulic drive assemblies 100-100'-100" are shown.

Figure 6A:
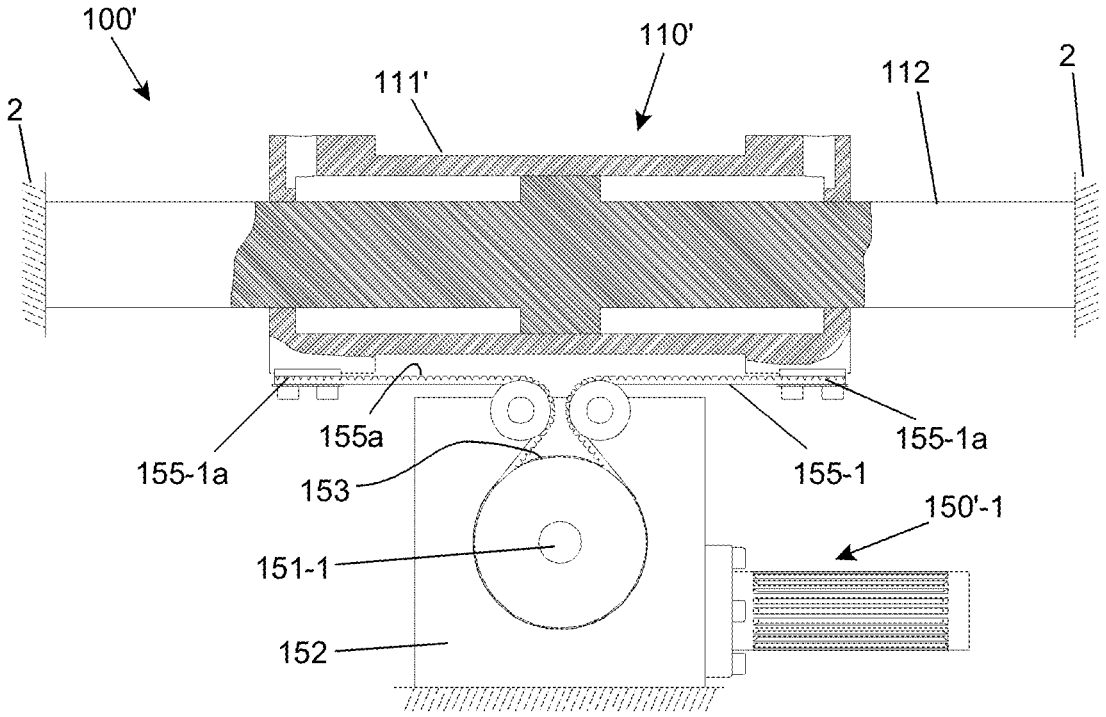

In FIG. 6A the main hydraulic cylinder corresponds to the main hydraulic cylinder 110' as depicted in FIG. 5B. The main drive means 150'-1 drives the main cylinder body 111' relative to the main piston rod 112 which is mounted with its both ends to the vessel's hull 2 (permanent world). Hereto the drive housing 152 of the main drive means 150'-1 is also mounted to the permanent world of the vessel's hull 2. In FIG. 6A the main drive means 150'-1 is depicted as a belt drive. The belt drive 150'-1 rotates a driving spindle 151-1 that exits the housing 152. The driving spindle 151-1 is provided with teeth 153, which interact with teeth 155*a* of a toothed belt 155-1, which toothed belt 155-1 is mounted with both ends 155-1*a* to either sides of the main hydraulic cylinder body 111'.

Figure 6B:
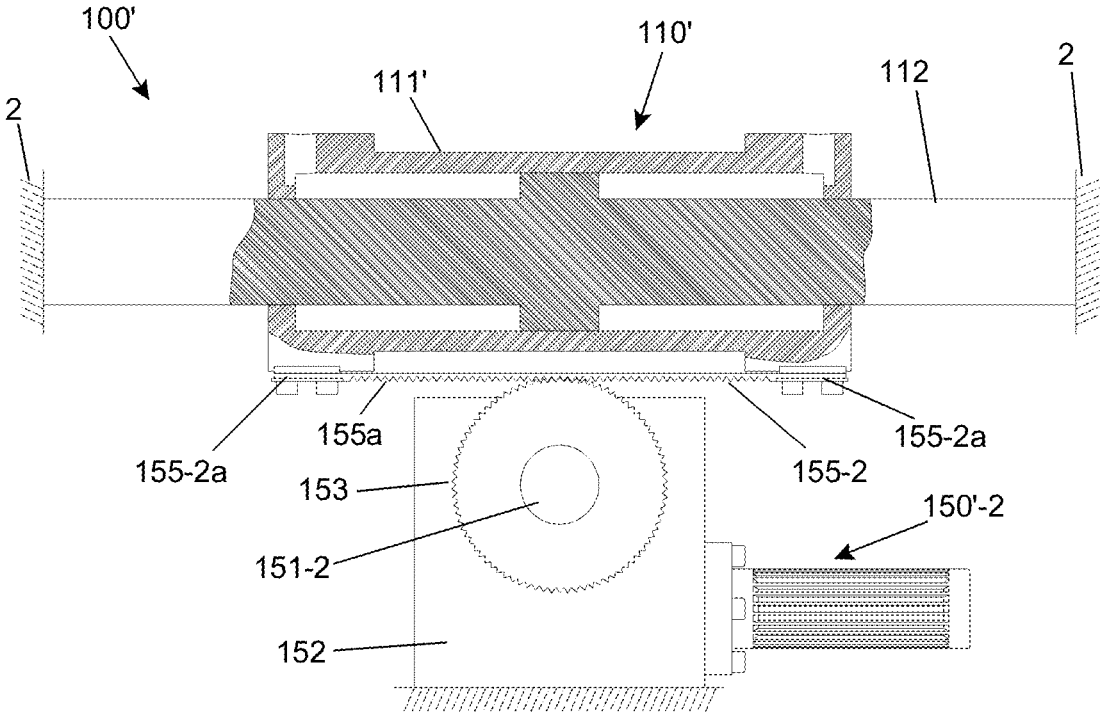

Also in FIG. 6B the main hydraulic cylinder corresponds to the main hydraulic cylinder 110' as depicted in FIG. 5B. The main drive means 150'-2 drives the main cylinder body 111' relative to the main piston rod 112 which is mounted with its both ends to the vessel's hull 2 (permanent world). Hereto the drive housing 152 of the main drive means 150'-2 is also mounted to the permanent world of the vessel's hull 2. In FIG. 6B the main drive means 150'-2 is depicted as a rack and pinion drive. The belt drive 150'-2 rotates a driving pinion 151-2 that exits the housing 152. The driving pinion 151-2 is provided with teeth 153, which interact with teeth 155*a* of a toothed rack 155-2, which toothed rack 155-2 is mounted with both ends 155-2*a* to either sides of the main hydraulic cylinder body 111'.

In both examples of FIGS. 6A and 6B the main drive means 150'-1 and 150'-2 is preferably mounted in a symmetrical manner (at equal distances) relative to the main hydraulic cylinder 110' allowing alternating equal strokes/equal displacements of the main cylinder body 111' in both directions along the fixed main piston rod 112.

In FIGS. 6C-6G other embodiments of the main drive means 150 are depicted, with the main hydraulic cylinder corresponding to the main hydraulic cylinder 110 as depicted in FIG. 5A. That is, in FIGS. 6C-6G the main cylinder body 111 is fixed to the vessel's hull 2 (permanent world) with the main drive means 150-1, 150-2, 150-3 driving the main piston rod 112 (and main piston 113) relative to the main cylinder body 111.

Figure 6C:
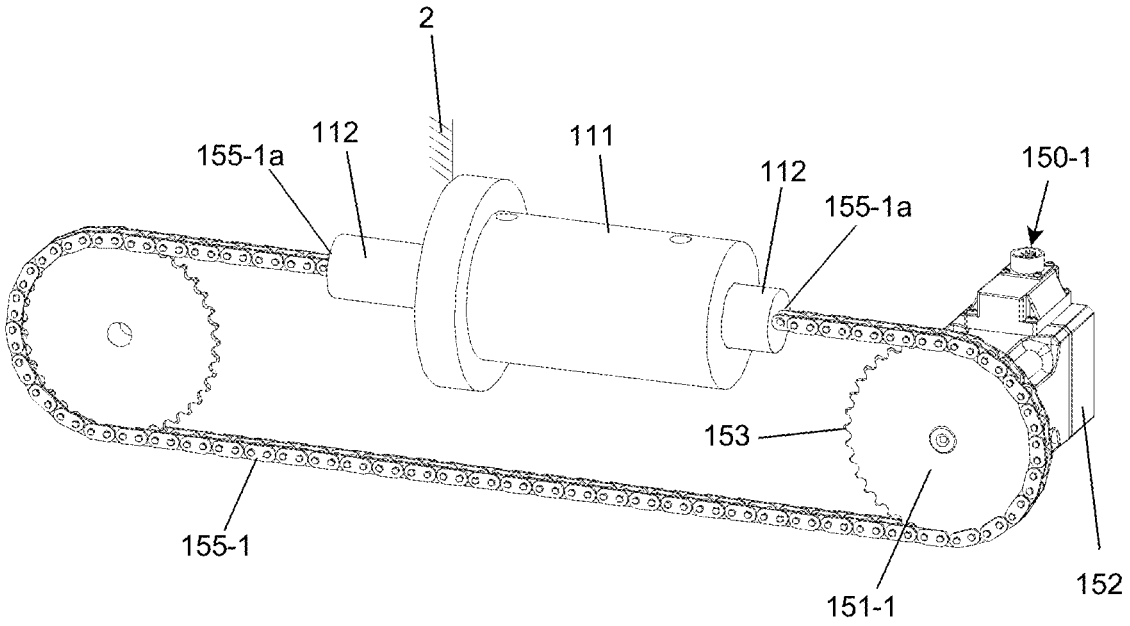

In FIG. 6C the main drive means 150-1 is depicted as a chain drive. The chain drive 150-1 rotates a driving spindle 151-1 that exits the housing 152. The driving spindle 151-1 is provided with teeth 153, which interact with a chain 155-1, which chain 155-1 is mounted with both ends 155-1*a* to either sides of the main piston 112. Back and forth rotation of the driving spindle 151-1 causes the main piston 112 (and main piston 113) via the chain 155-1 to be displaced back and forth in the main cylinder body 111.

Figure 6D:
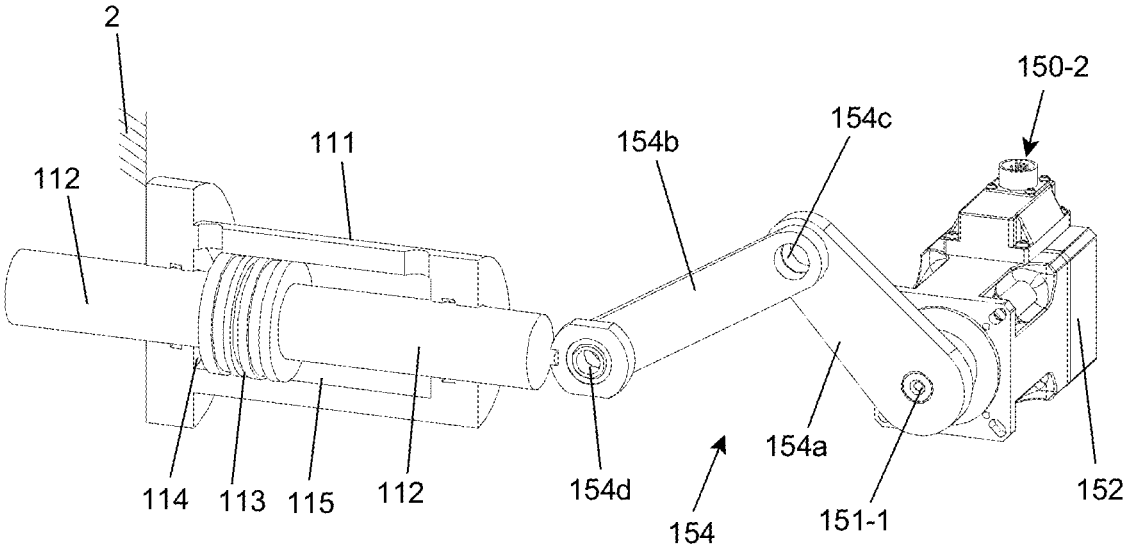

In FIG. 6D the main drive means 150-1 is depicted as a lever drive. The lever drive 150-1 rotates a driving spindle 151-1 that exits the housing 152. The driving spindle 151-1 is provided with a lever element 154*a*, which lever element 154*a* is interconnected with a second lever element 154*b* by means of a hinge 154*c*. The second lever element 154*b* is in turn connected with the main piston 112 via a hinge 154*d*. Rotation of the driving spindle 151-1 causes the main piston 112 (and main piston 113) via the lever mechanism 154 to be displaced back and forth in the main cylinder body 111.

Figure 6E:
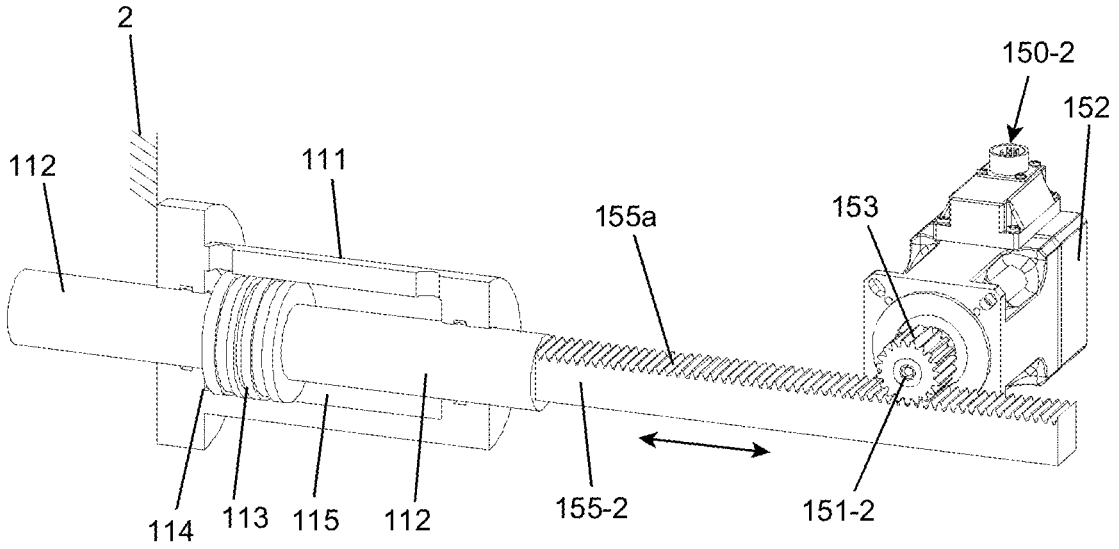

In FIG. 6E the main drive means 150-2 is depicted as a rack and pinion drive, more or less similar to the embodiment depicted in FIG. 6B. The rack and pinion drive 150-2 rotates a driving pinion 151-2 that exits the housing 152. The driving pinion 151-2 is provided with teeth 153, which interact with the teeth 155*a* of a toothed rack 155-2. The toothed rack 155-2 forms an extension of the main piston 112. Back and forth rotation of the driving pinion 151-2 causes the main piston rod 112 (and main piston 113) via the toothed rack 155-2 to be displaced back and forth in the main cylinder body 111.

FIG. 6F-a and FIG. 6F-b show—combined—an alternative for the embodiment depicted in FIG. 6E. In this embodiment the main drive means 150-2 drive two main hydraulic cylinders 110-110', each comprising a main piston/cylinder combination 111-112-113/111'-112'-113', each composed of a main cylinder body 111/111' and a main piston 113/113' accommodated in the main cylinder body 111/111'. Similar as to the embodiments shown in FIGS. 5A-5C each main piston 113/113' is mounted to a main piston rod 112/112' that projects from the corresponding main cylinder body 111/111'.

The main drive means 150-2 of FIG. 6F-a actuate dual or two rack and pinion drives denoted with reference numerals 155-2/155-2'. The toothed racks 155-2/155-2' are driven by the central driving pinion 151-2 that exits the housing 152. The driving pinion 151-2 is provided with teeth 153, which interact with the teeth 155*a*/155*a*' of the toothed racks 155-2/155-2'. The toothed racks 155-2/155-2' each form an extension of the main piston rods 112/112' of each main hydraulic cylinder 110/110'. Back and forth rotation of the driving pinions 151-2/151-2' causes the main piston rods 112/112' (and main pistons 113/113') via the toothed racks 155-2/155-2' to be displaced back and forth in the corresponding main cylinder bodies 111/111'.

The back and forth displacement of the main pistons 113 in their respective main cylinder bodies 111 cause a similar increase/decrease of the first and second main cylinder chambers 114-115 at each side of the main pistons 113/113'. This results in fluid displacement to and fro the respective first and second auxiliary cylinder chambers of the auxiliary hydraulic cylinder 120, similar as in the embodiments of FIGS. 5A and 5B, and alternatively also to the second auxiliary hydraulic cylinder 140 similar as to FIG. 5C.

The latter embodiment of FIG. 5C is replicated in FIG. 6F-b, depicting the first and second auxiliary hydraulic cylinders 120-140, both auxiliary hydraulic cylinders 120-140 intended for moving one, single stabilisation element 4. Also here, the second auxiliary hydraulic cylinder 140 has an identical configuration and dimensions as that of the first auxiliary hydraulic cylinder 120. Also the second auxiliary hydraulic cylinder 140 is composed of an auxiliary cylinder body 141 and an auxiliary piston 143 accommodated in the auxiliary cylinder body 141. The auxiliary piston 143 is mounted to an auxiliary piston rod 142 that projects at one side from the auxiliary cylinder body 141.

Although not depicted in FIG. 6F-b, but similarly as in FIG. 5C, the auxiliary cylinder body 141 and the auxiliary piston 143 define a first auxiliary cylinder chamber 144 at one side 141*a* of the auxiliary piston 143 (and the auxiliary hydraulic cylinder 140) and a second auxiliary cylinder chamber 145 at the other side 142*a* of the auxiliary piston 143 (and the auxiliary hydraulic cylinder 140). Both auxiliary cylinder bodies 121-141 are fixed with their ends 121*a*-141*a* to the vessel's hull 2 (permanent world). The auxiliary piston rods 122-142 of both the first and second auxiliary cylinder 120-140 are coupled with their free ends 122*a*-142*a* to a pivoting yoke 160 for pivoting the stabilisation element 4 around its stabilisation axis 40, as will be explained further in the description.

As to the direct fluid interconnection of the several cylinder chambers 114'114'-115/115'; 124-125 and 144-145 the first auxiliary cylinder chamber 124 of the first auxiliary cylinder 120 is interconnected with the second auxiliary cylinder chamber 145 of the second auxiliary cylinder 140 and the first auxiliary cylinder chamber 144 of the second auxiliary cylinder 140 is interconnected with the second auxiliary cylinder chamber 125 of the first auxiliary cylinder 120 by means of intermediate first and second fluid lines 131*a*' and 131*b*', respectively via suitable fluid connections or couplings 124*a*-125*a*-144*a*-145*a*.

Also in this embodiment the hydraulic system as to hydraulic lines 131*a*-131*b*-131*a*'-131*b*' provide a direct fluid connection between the cylinder chambers 114/114'-115/115' of the two main hydraulic cylinders 110/110' and the cylinder chambers 124-144; 125-145 of the auxiliary hydraulic cylinders 120-140 and is quite similar to the example depicted in FIG. 5C. The first main cylinder chambers 114/114' are interconnected with the first auxiliary cylinder chamber 124 and the second main cylinder chambers 115/115' are interconnected with the second auxiliary cylinder chamber 125 by means of combined first and second fluid lines 131*a* and 131*b*, respectively.

Similarly, each cylinder chamber 114-115-124-125-144-145 is provided with suitable fluid connections or couplings 114*a*-115*a*-124*a*-125*a*-144*a*-145*a*, respectively, which connections or couplings are known in the art and capable of withstanding the high fluid pressures and fluid velocities, which might occur during the alternating cycles of the hydraulic moving means 100-100'. As in the example of FIG. 5C, also in this embodiment the (volume of the) first main cylinder chamber 114, the (volume of the) first auxiliary cylinder chamber 124 of the first auxiliary cylinder 120 and the (volume of the) second auxiliary cylinder chamber 145 of the second auxiliary cylinder 140 form a combined fluid volume (together with the volumes of the first fluid line 131*a* and the first intermediate fluid line 131*a*'). Likewise the (volume of the) second main cylinder chamber 115, the (volume of the) second auxiliary cylinder chamber 125 of the first auxiliary cylinder 120 and the (volume of the) first auxiliary cylinder chamber 144 of the second auxiliary cylinder 140 form a combined fluid volume (together with the volumes of the second fluid line 131*b* and the second intermediate fluid line 131*b*'). As shown, the several interconnected cylinder chambers 114-124-145 (and 115-125-144) form a system of communicating vessels.

It will be clear that the dual rack and pinion embodiment of FIG. 6F-a can also be implemented to drive the at least one auxiliary hydraulic cylinder for moving the stabilisation element 4 relative to the hull as depicted in the embodiments of FIGS. 5A-5B and FIGS. 7B-7E. In all these dual rack and pinion embodiments the use of two rack and pinion drive means provide a better and more accurate actuation as well as an improved induced force control.

Figure 6G:
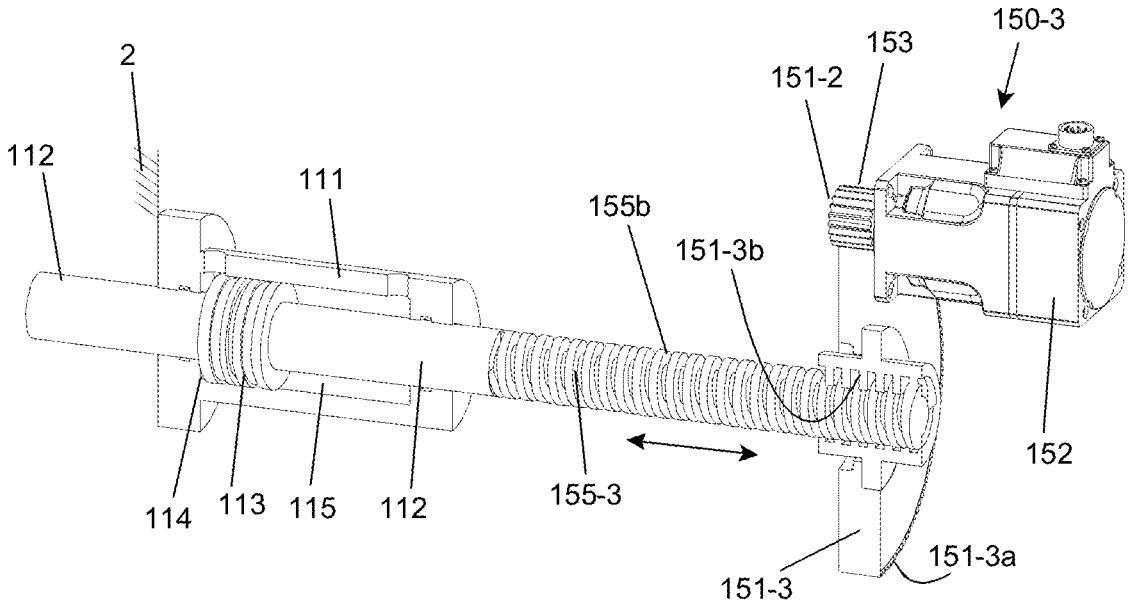

In FIG. 6G the main drive means 150-3 is depicted as a spindle drive. The spindle drive 150-3 rotates a driving pinion 151-2 that exits the housing 152. The driving pinion 151-2 is provided with teeth 153, which interact with the outer teeth 151-3*a* of a spindle pinion 151-3. The spindle pinion 151-3 is also provided with a centre bore provided with an inner screw thread 151-3*b* which interacts with an outer screw thread provided on a piston spindle 155-3, which forms an extension of the main piston 112. Back and forth rotation of the driving pinion 151-2 causes the main piston 112 (and main piston 113) via the spindle pinion 151-3 to be displaced back and forth in the main cylinder body 111.

It is noted that in the embodiments as depicted in FIGS. 6A-6G the main drive means 150

FIGS. 7A-7E depict several examples of active stabilisation systems implementing different embodiments of the moving means 100-100'-100" according to the invention.

In the FIGS. 7A-7E reference numeral 4 depicts a stabilisation element for use in an active roll stabilisation system for compensating or counteracting the roll movements of a vessel. In practise an active roll stabilisation system implements at least one set of two stabilisation elements 4, with each stabilisation element 4 being positioned at either longitudinal side of the hull 2 of the vessel 1 below the waterline or water surface 3. As shown in the FIGS. 7A-7E the stabilisation element 4 is mounted to a rotation axis 40, which projects in a water tight manner from the hull 2. Inside the hull 2 the rotation axis 40 is coupled to either example of the moving means 100-100'-100" as described in relation to the FIGS. 5A-5C and 6A-6B.

As outlined with reference to the FIGS. 1-4 an active roll stabilisation system comprises sensor means (not depicted) for sensing the vessel's roll movements at anchor or and the sensor means generate and deliver control signals on the basis thereof to the moving means 100-100'-100" for imparting a reciprocating pivoting (or translational) movement via the mounting axis 40 to the stabilisation element 4 in order to compensate or counteract the vessel's roll movements as detected by the sensor means.

In the FIGS. 7A-7E the stabilisation element 4 is shaped as a wing, but it is to be noted that the stabilisation element 4 can also be configured as a rotating cylinder as depicted and described in FIGS. 1-4, using the Magnus effect as the correction force for opposing the vessel's roll.

Figure 7A:
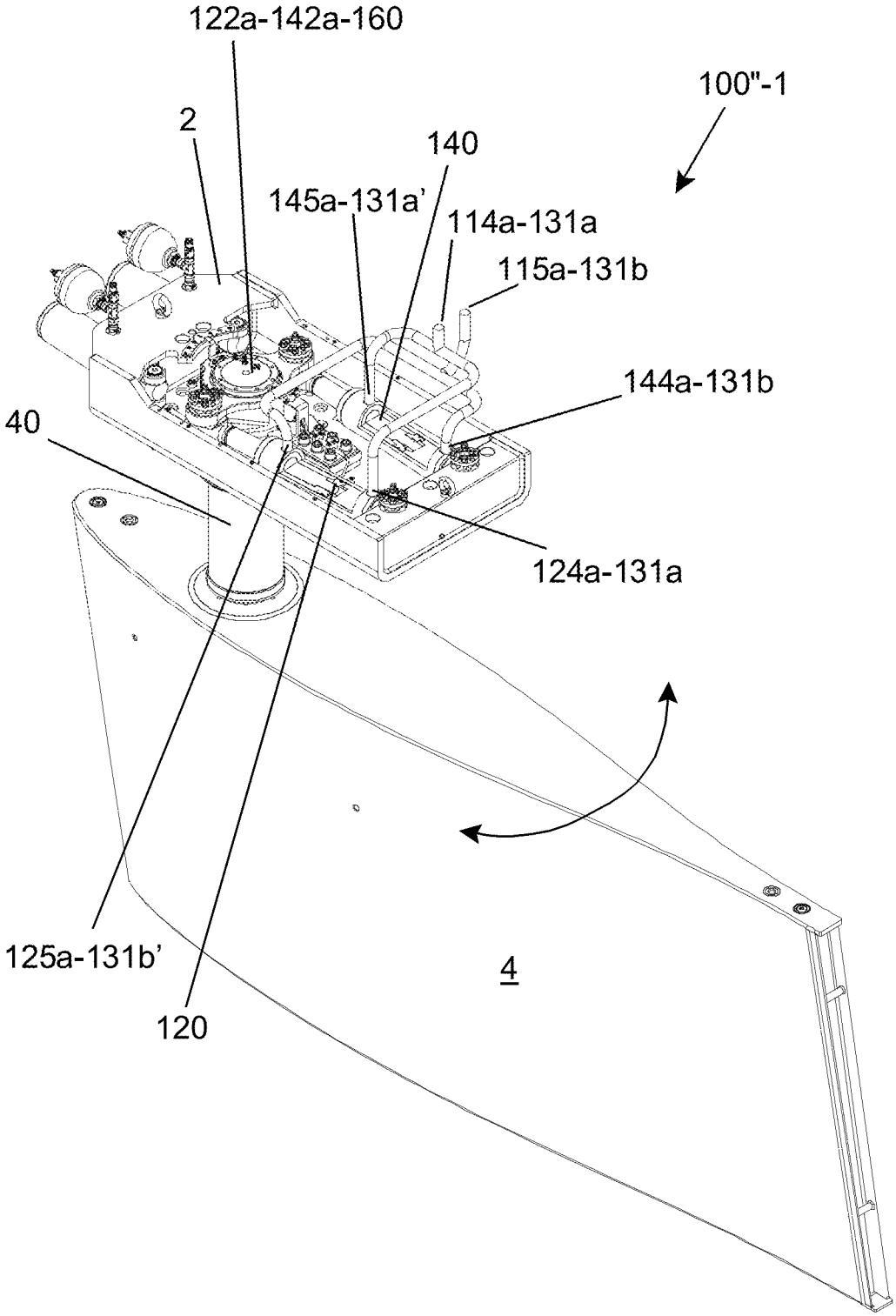
FIGS. 7A-7E several embodiments of active stabilisation systems implementing different embodiments of the moving means according to the invention.
Figure 7B:
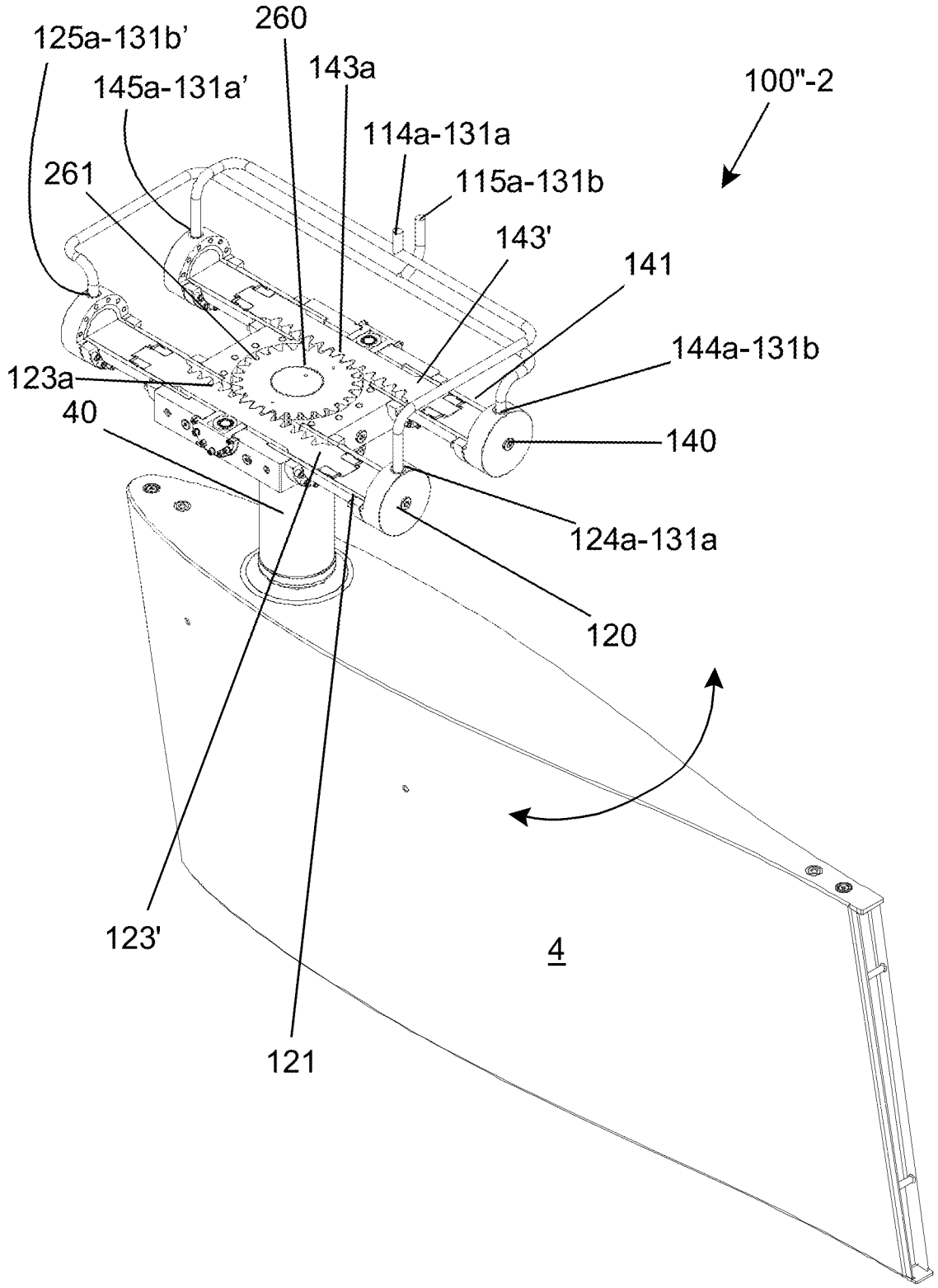

In FIGS. 7A-7B the moving means are configured as the hydraulic drive assembly 100", similar to the example depicted in FIG. 5C and FIG. 6F-b, which comprises next to the first auxiliary hydraulic cylinder 120 also a second corresponding auxiliary hydraulic cylinder 140, as well as a rotating yoke 160. The rotating yoke 160 is connected with the free ends 122*a*-142*a* of the two auxiliary piston rods 122 and 144 of the two auxiliary hydraulic cylinders 120-140. Furthermore the yoke 160 is mounted to the mounting/rotating axis 40 of the stabilisation element 4.

Thus the alternating displacement of the auxiliary piston rods 122-144 due to the displacement of the hydraulic fluid in the several cylinder chambers caused by the operation of the main hydraulic cylinder 110 (or 110') results in an alternating rotation of the yoke 160 and the axis 40 and similarly in a rotation of the wing-shaped stabilisation element 4 relative to the hull 2 of the vessel 1 in order to compensate or counteract the vessel's roll movements as detected by the sensor means.

In FIG. 7A the example of the hydraulic drive assembly 100"-1 is 100% similar to the example depicted in FIG. 5C and denoted with reference numeral 100".

In FIG. 7B an alternative example is depicted and indicated as hydraulic drive assembly 100"-2. The hydraulic system as to hydraulic lines 131*a*-131*b*-131*a*'-131*b*' provide a direct fluid connection between the cylinder chambers 114-115 of the main hydraulic cylinder 110 and the cylinder chambers 124-144; 125-145 of the auxiliary hydraulic cylinders 120-140 and is quite similar to the example depicted in FIG. 5C. The pivoting yoke 160 of FIGS. 5C and 7A is now replaced by a rack and pinion transmission 260-261-143'-123'-143*a*-124*a*.

The rack and pinion transmission is formed by a pinion spindle 260 mounted to the mounting/rotating axis 40 of the wing-shaped stabilisation element 4. Pinion spindle 260 is provided with teeth 261 around its circumference, which teeth 261 mesh with teeth 123*a*-143*a* present on auxiliary piston rods 123' and 143' of the auxiliary hydraulic cylinders 120-140. Each toothed auxiliary piston rods 123' and 143' acts as a toothed rack and the alternating displacement of the toothed auxiliary piston rods 123' and 143' in their respective auxiliary cylinder bodies 121-141 due to the operation of the main hydraulic cylinder 110 (or 110') results in a rotation of the pinion spindle 260, the mounting axis 40 and thus the wing-shaped stabilisation element 4 relative to the hull 2 of the vessel 1 in order to compensate or counteract the vessel's roll movements as detected by the sensor means.

Figure 7C:
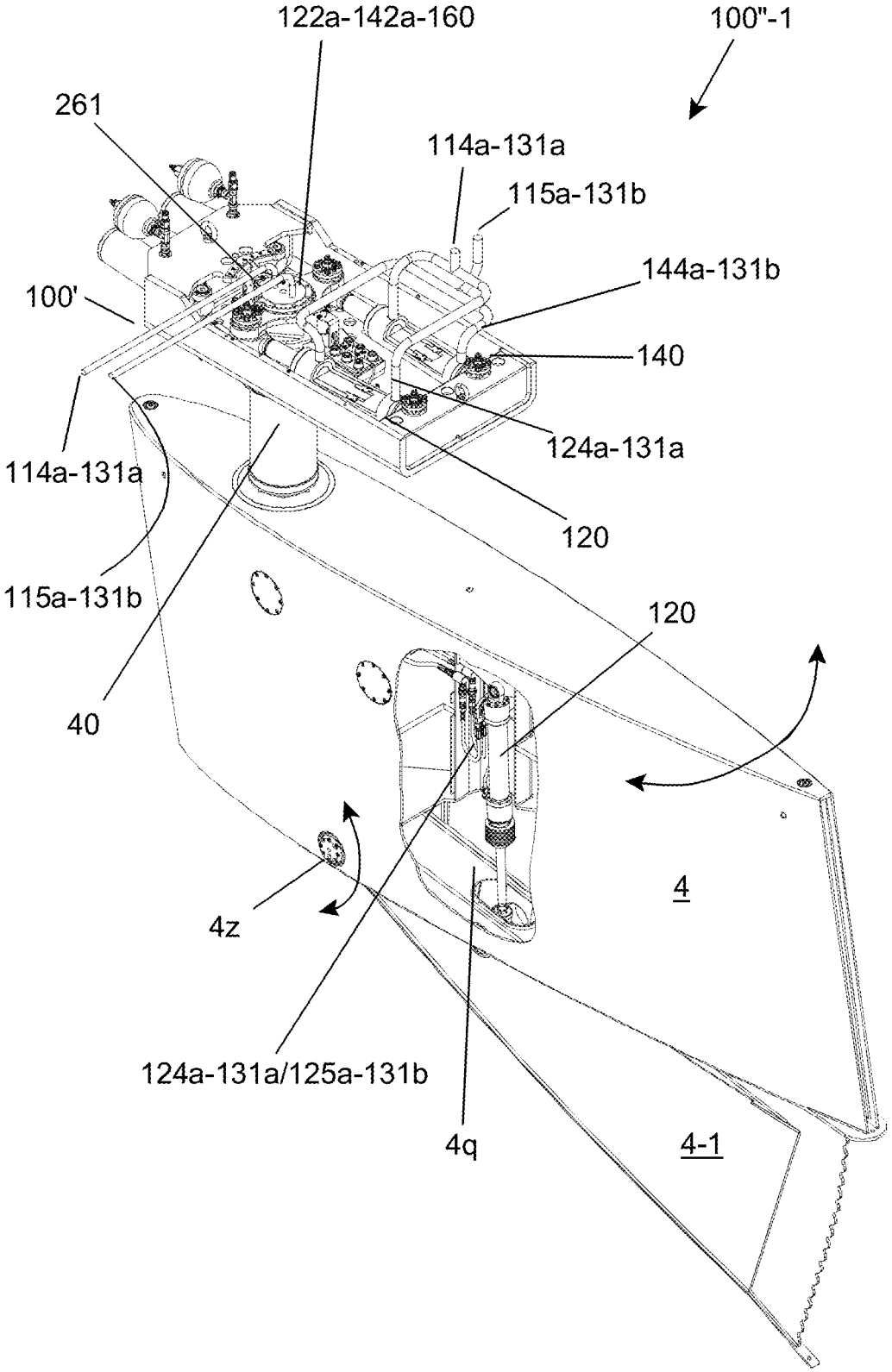
Figure 7D:
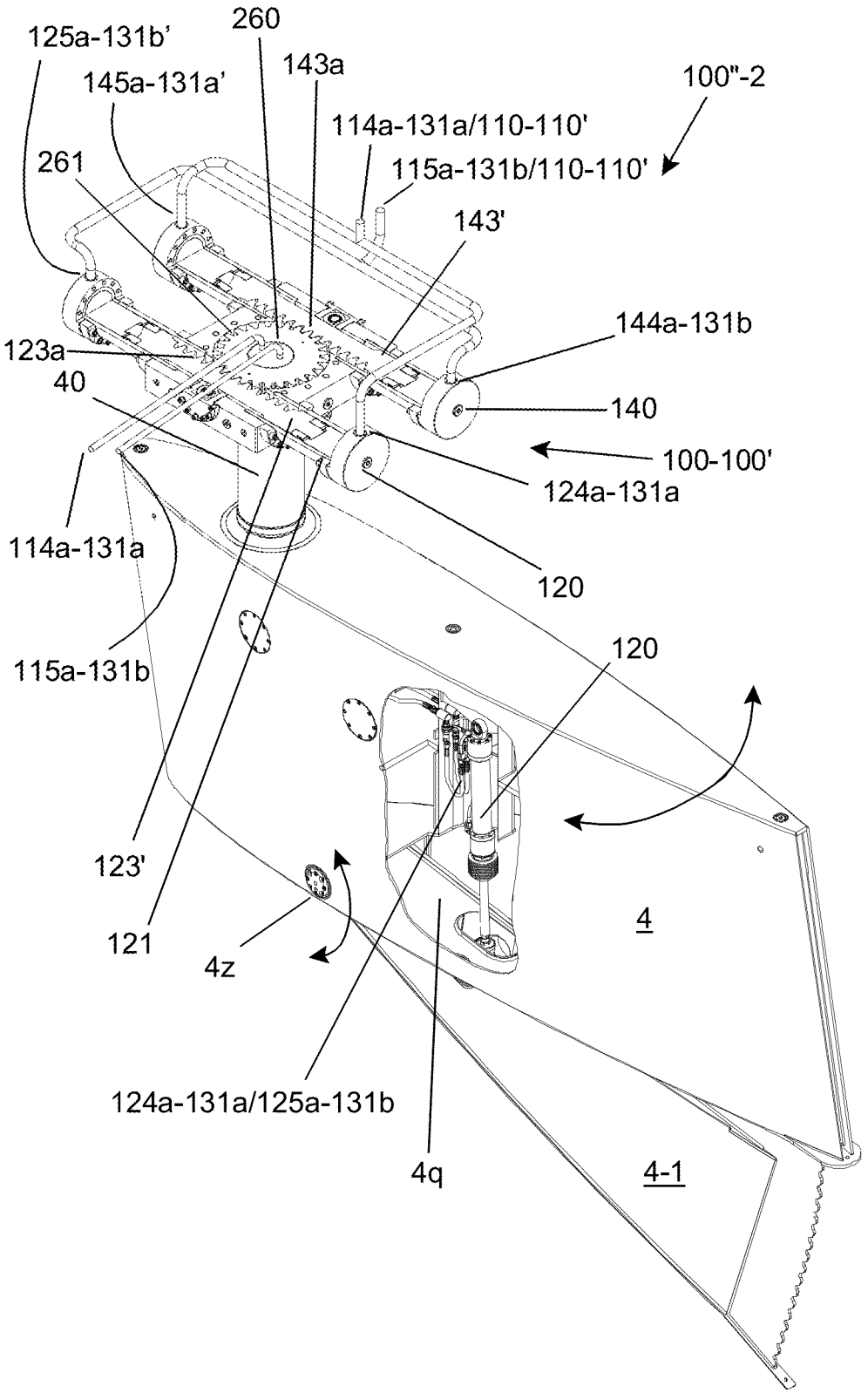
Figure 7E:
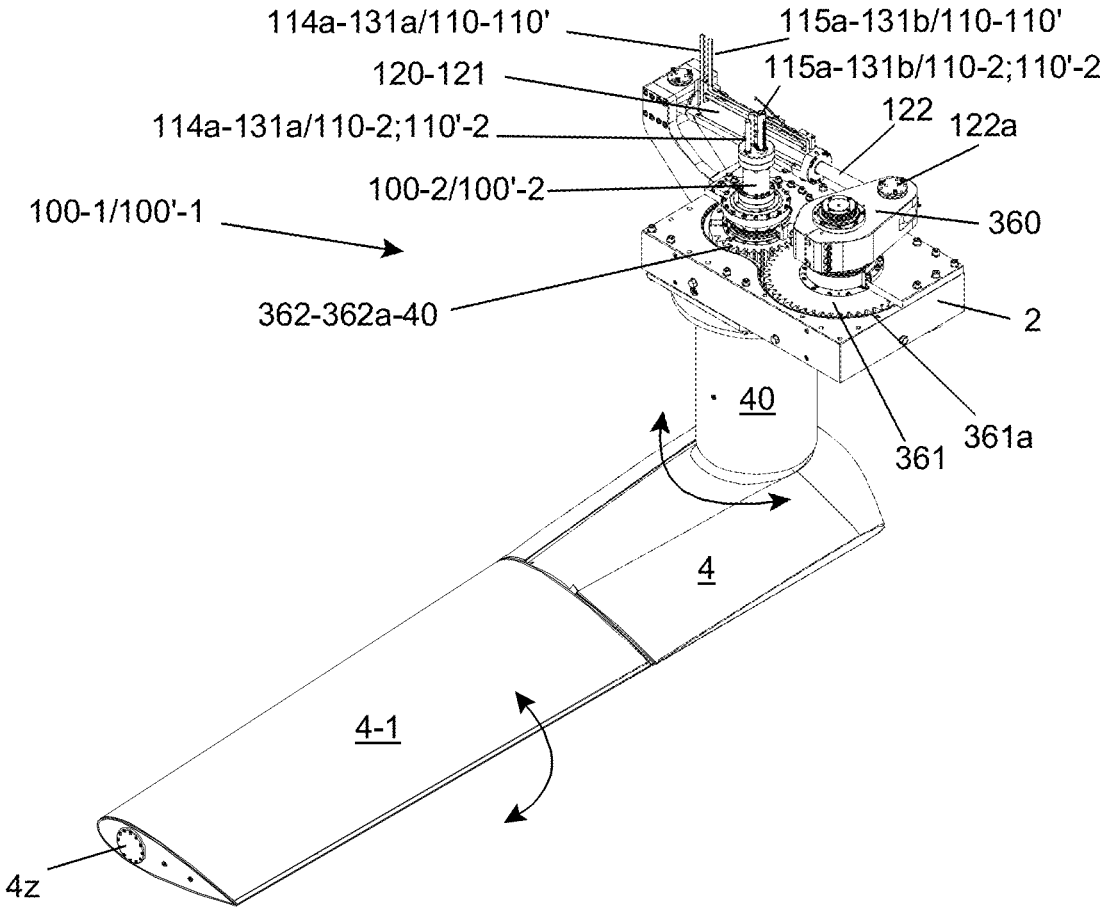

FIGS. 7C-7E depict another examples of an active roll stabilisation system according to the invention. In these Figures the wing-shaped stabilisation element 4 is provided with a sub-element 4-1 (FIGS. 7C-7D) and 4-2 (FIG. 7E), respectively, which sub-element 4-1, 4-2 is movable with respect to the stabilisation element 4. In the examples of FIGS. 7C-7D the sub-element 4-1 can be moved in and out of the main body of the stabilisation element 4. To this end the main body of the wing-shaped stabilisation element is (in part) hollow and the sub-element 4-1 is likewise wing- or plate-shaped and can be moved in and out as an extension blade of the hollow compartment 4*q* formed in the stabilisation element 4.

In particular the movement of the sub-element/extension blade 4-1 in and out of the stabilisation element 4 is a pivoting movement around a rotation axis/pivoting point 4*z*.

In the example of FIG. 7C, for the in and out movement of the sub-element/extension blade 4-1 the moving means for this particular single one stabilisation element 4 comprise a second hydraulic drive assembly, indicated with reference numeral 100/100' next to the first hydraulic drive assembly 100"-1. The first hydraulic drive assembly 100"-1 used in the example of FIG. 7C is identical to the examples depicted and described in FIGS. 5C and 7A with the dual auxiliary hydraulic cylinder-yoke configuration 120-140-160. The second hydraulic drive assembly 100/100' is configured according to the examples depicted in FIG. 5A or 5B, implementing one, single auxiliary hydraulic cylinder 120.

The first hydraulic drive assembly 100"-1 of the moving means serves to impart a pivoting movement via the pivoting yoke 160 to the stabilisation element 4 around its rotation axis 40 in the direction of the stem or the stern of the vessel 1.

The second hydraulic drive assembly 100/100' is arranged for moving the sub-element 4-1 with respect to the stabilisation element 4. The sub-element 4-1 is connected to the free end 122*a* of the auxiliary piston rod 122 of the auxiliary hydraulic cylinder 120, whereas the other end 121*a* of the auxiliary hydraulic cylinder 120 is mounted in a fixed manner to the main body of the stabilisation element 4, thus serving as permanent world, in a fashion similar to the example depicted in FIGS. 5A and 5B. The main cylinder 110 (or 110') of the second hydraulic drive assembly 100/100' drives in a similar fashion as described above due to the direct fluid connection between the cylinder chambers of the main hydraulic cylinder 110 (110') and the cylinder chambers of the auxiliary hydraulic cylinder 120 the auxiliary piston rod 122 in alternating forward and return operational cycles (out and in cycles) due to the subsequent volume decrease/increase in the several cylinder chambers, causing the sub-element/extension blade 4-1 to hinge in and out of the hollow compartment 4*q* of the stabilisation element 4 around the pivoting point 4*z*.

Herewith a significant increase in wing surface can be created and as such an additional correction force, which increased force is used as a lifting force for opposing the vessel's roll movements. Herewith the Aspect-Ratio of the wing-shaped stabilisation element 4 can be set between am A/R range of 1 and 10. By using a wing-shaped stabilisation element having such a large Aspect-Ratio, an enhanced lifting effect for damping the vessel's roll is realised, so that the active roll stabilisation system provided with such a wing-shaped stabilisation element (having a high AR) as depicted in FIGS. 7C and 7D can also be used for applications other than roll stabilisation, for example for trimming the vessel, or for compensating for the vessel's pitch or even for repositioning or manoeuvring the vessel without making use of the usual main propulsion system of the vessel or of bow and stern thrusters.

In FIG. 7D another example is depicted more or less similar to the example of FIG. 7C. The first hydraulic drive assembly 100"-2 drives the main body of the stabilisation element 4 and is identical to the example depicted and described in FIG. 7B with the dual auxiliary hydraulic cylinder-yoke configuration 120-140-260 with the rack and pinion transmission. The second hydraulic drive assembly 100/100' drives the sub-element 4-1 and is configured according to the examples depicted in FIG. 5A or 5B and 7C, implementing one, single auxiliary hydraulic cylinder 120.

The example of FIG. 7E depicts another active roll stabilisation system according to the invention for driving one, single wing-shaped stabilisation element 4 having a sub-element 4-2 shaped as an additional wing-shaped sub-element. The wing-shaped sub-element 4-2 can be tilted around its rotation axis/pivoting point 4*z*. The moving means for this particular single, one stabilisation element 4 comprise a second hydraulic drive assembly, indicated with reference numeral 100-2/100'-2 next to the first hydraulic drive assembly indicated with 100-1/100'-1.

The first hydraulic drive assembly 100-1/100'-1 used in the example of FIG. 7E is identical to the examples depicted and described in FIG. 5A or 5B with the single auxiliary hydraulic cylinder configuration 120. The second hydraulic drive assembly 100-2/100'-2 is likewise configured according to the examples depicted in FIG. 5A or 5B, implementing one, single auxiliary hydraulic cylinder 120. The first hydraulic drive assembly 100-1/100'-1 of the moving means serves to impart a pivoting movement to the stabilisation element 4 around its rotation axis 40 in the direction of the stem or the stern of the vessel 1. As to the first hydraulic drive assembly 100-1/100'-1 the free end 122*a* of the auxiliary piston rod 122 of the auxiliary hydraulic cylinder 120 is mounted to the pivoting yoke 360, whereas the other end 121*a* of the auxiliary hydraulic cylinder 120 is mounted in a fixed manner to the hull 2 of the vessel 1, thus serving as permanent world, in a fashion similar to the example depicted in FIGS. 5A and 5B.

The pivoting yoke is provided with a yoke gear 361 provided with teeth 361*a*, which teeth mesh with teeth 362*a* of the element gear 362. Element gear 362 is mounted to the rotation/mounting axis 40 of the wing-shaped stabilisation element 4. The first hydraulic drive assembly 100-1/100'-1 of the moving means impart a pivoting movement via the pivoting yoke 360 to the stabilisation element 4 around its rotation axis 40 in the direction of the stem or the stern of the vessel 1 to compensate or counteract the vessel's roll movements as detected by the sensor means.

The main cylinder 110 (or 110') of the second hydraulic drive assembly 100-2/100'-2 drives in a similar fashion as described above due to the direct fluid connection between the cylinder chambers 114-115 of the main hydraulic cylinder 110-110' and the cylinder chambers of the auxiliary hydraulic cylinder 120 and the auxiliary piston rod 122 in alternating forward and return operational cycles (out and in cycles) due to the subsequent volume decrease/increase in the several cylinder chambers, causing the wing-shaped sub-element 4-2 to tilt around the pivoting point 4*z*. Herewith a tilt angle of the wing-shaped sub-element 4-2 can be set, which tilt angle together with the pivoting movement of the main body of the stabilisation element 4 to generate an additional lift, which lift is used as a correction force for opposing the vessel's roll movements.

This makes it possible, by imparting a "wagging" motion to the wing-shaped stabilisation element, to keep the vessel in its position in the harbour, or even move it over small distances, without making use of the vessel's main propulsion system, so that manoeuvres can be carried out in a controlled manner 12. Additional the wing-shaped stabilisation element can be provided with a winglet at its free end, which winglet can be directed toward or away the water surface.

LIST OF REFERENCE NUMERALS

1 vessel
2 hull
3 water surface
4/4*a*/4*b* stabilisation element
4-1 sub-element/extension blade of stabilisation element
4-2 wing-shaped sub-element
4*q* hollow compartment of sub-element 4-1
4*z* rotation/pivoting axis of sub-element 4-1/4-2
6 driving means
10/10'/20/20' moving means (prior art)

11 guide
12 universal joint
13 longitudinal axis of stabilisation element
40 mounting axis/rotation axis of stabilisation element
100/100' moving means/hydraulic drive assembly ($1^{st}/2^{nd}$ embodiment)
100"/100"-1/100"-2 moving means/hydraulic drive assembly ($3^{rd}/4^{th}/5^{th}$ embodiment)
110/110' main hydraulic cylinder ($1^{st}/2^{nd}$ embodiment)
111 main cylinder body
112 main piston rod
113 main piston
114 first main cylinder chamber
114*a* fluid line connection/coupling of first main cylinder chamber
115 second main cylinder chamber
115*a* fluid line connection/coupling of second main cylinder chamber
120/140 auxiliary hydraulic cylinder
121/141 auxiliary cylinder body
121*a*/141*a* auxiliary cylinder body end
122/142 auxiliary piston rod
122*a*/142*a* auxiliary piston rod end
123/143 auxiliary piston
124/144 first auxiliary cylinder chamber
124*a*/144*a* fluid line connection/coupling of first auxiliary cylinder chamber
125/145 second auxiliary cylinder chamber
125*a*/145*a* fluid line connection/coupling of second auxiliary cylinder chamber
131*a* first fluid line
131*a*' first intermediate fluid line
131*b* second fluid line
131*b*' second intermediate fluid line
123'/143' toothed auxiliary piston
123*a*/143*a* teeth of toothed auxiliary piston
150 main drive means
150-1/150'-1 belt drive means (embodiments of main drive means)
150-2/150'-2 rack and pinion drive means (embodiments of main drive means)
150-3 spindle drive means (embodiment of main drive means)
151-1 driving spindle
151-2 driving pinion
151-3 spindle pinion
151-3*a* outer toothing of spindle pinion
151-3*b* inner screw thread
152 housing
153 toothing of driving spindle/driving pinion
155-1 toothed belt
155-2 toothed rack
155-3 piston spindle
155*a* teeth of belt/teeth of rack
155*b* screw thread of piston spindle
155-1*a*/155-2*a* ends of belt, chain or rack
160/260/360 yoke
261 teeth of yoke 260
361 yoke gear mounted to yoke 360
361*a* teeth of yoke gear 361
362 element gear of stabilisation element 4
362*a* teeth of element gear

The invention claimed is:

1. An active roll stabilization system for a vessel, comprising:

at least one stabilization element configured to extend from a hull of a vessel, below the water line, on a side of the vessel;

a sensor configured to sense vessel motion and deliver control signals based on the sensed vessel motion; and a hydraulic drive assembly for moving the at least one stabilization element relative to the hull in dependence on at least the delivered control signals, wherein the hydraulic drive assembly is configured to impart at least pivoting movement in a direction of the stern of the vessel or in a direction from the stem of the vessel to the at least one stabilization element;

wherein the hydraulic drive assembly comprises at least one auxiliary hydraulic cylinder configured to move the at least one stabilization element relative to the hull, and a main hydraulic cylinder configured to drive the at least one auxiliary hydraulic cylinder, wherein the auxiliary hydraulic cylinder and the main hydraulic cylinder are in direct fluid connection with each other.

2. The system according to claim 1, wherein the main hydraulic cylinder comprises at least one main piston and cylinder assembly comprising a main cylinder body and a main piston disposed in the main cylinder body and including a main piston rod extending from the main cylinder body, the main cylinder body and the main piston forming a first main cylinder chamber positioned at one side of the main piston and a second main cylinder chamber positioned at an opposing side of the main piston, and wherein the hydraulic drive assembly further comprise a main driver configured to drive the main piston rod and the main cylinder body relative to each other in alternating forward and return operational cycles.

3. The system according to claim 2, wherein the main driver is configured to drive the main cylinder body and the main piston rod, and wherein the main piston rod and the main cylinder body is fixed to the hull of the vessel.

4. The system according to claim 3, wherein the main piston rod and the main cylinder body are fixed to the hull of the vessel by a vibration-free suspension assembly.

5. The system according to claim 2, wherein the at least one auxiliary hydraulic cylinder comprises at least one auxiliary piston and cylinder assembly comprising an auxiliary cylinder body and an auxiliary piston disposed in the auxiliary cylinder body and including an auxiliary piston rod extending from the auxiliary cylinder body, the auxiliary cylinder body and the auxiliary piston defining a first auxiliary cylinder chamber positioned at one side of the auxiliary piston and a second auxiliary cylinder chamber positioned at an opposing side of the auxiliary piston, and wherein the main cylinder is configured to drive the auxiliary piston and the auxiliary cylinder body relative to each other in alternating forward and return operational cycles.

6. The system according to claim 5, wherein the main cylinder is configured to drive the auxiliary cylinder body and the auxiliary piston rod, and wherein the auxiliary piston rod and the auxiliary cylinder body is fixed to the hull of the vessel.

7. The system according to claim 5, wherein the first main cylinder chamber is interconnected with the first auxiliary cylinder chamber and the second main cylinder chamber is interconnected with the second auxiliary cylinder chamber by fluid lines.

8. The system according to claim 5, wherein the at least one auxiliary hydraulic cylinder comprises a second corresponding auxiliary hydraulic cylinder for moving the at least one stabilization element, wherein the auxiliary piston rods of each of the first and second auxiliary cylinders are coupled to a pivoting yoke for pivoting the at least one stabilization element.

9. The system according to claim 8, wherein the first auxiliary cylinder chamber of the first auxiliary cylinder is interconnected with the second auxiliary cylinder chamber of the second auxiliary cylinder and the first auxiliary cylinder chamber of the second auxiliary cylinder is inter connected with the second auxiliary cylinder chamber of the first auxiliary cylinder by fluid lines.

10. The system according to claim 2, wherein the main driver comprises at least one of a spindle drive, a belt drive, and a rack-and-pinion drive.

11. The system according to claim 1, wherein the at least one stabilization element comprises a sub-element movable relative to the at least one stabilization element, and wherein the hydraulic drive assembly comprises a second hydraulic drive assembly, wherein the second hydraulic drive assembly is configured to move the sub-element relative to the at least one stabilization element.

12. The system according to claim 11, wherein the sub-element is configured to move in an out of a main body of the at least one stabilization element.

13. The system according to claim 1, wherein the at least one stabilization element is wing-shaped.

14. The system according to claim 13, further comprising a winglet positioned at a free end of the at least one stabilization element.

15. The system according to claim 14, wherein the winglet is configured to be angled toward or away from the surface of the water.

16. The system according to claim 13, wherein the at least one stabilization element, being wing-shaped, has an aspect ratio between 1 and 10.

17. The system according to claim 1, comprising at least one stabilization element positionable on each longitudinal side of a vessel.

18. The system according to claim 1, comprising a plurality of stabilization elements positionable proximate a rear of a vessel.

19. A hydraulic drive assembly comprising the at least one auxiliary hydraulic cylinder for moving a load in alternating forward and return operational cycles and the main hydraulic cylinder for driving the at least one hydraulic cylinder according to claim 1.

* * * * *